US009443685B2

(12) United States Patent
Yamamoto et al.

(10) Patent No.: US 9,443,685 B2
(45) Date of Patent: Sep. 13, 2016

(54) CONTACT DEVICE

(71) Applicant: PANASONIC INTELLECTUAL PROPERTY MANAGEMENT CO., LTD., Osaka (JP)

(72) Inventors: Ritsu Yamamoto, Mie (JP); Tsukasa Nishimura, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/720,730

(22) Filed: May 22, 2015

(65) Prior Publication Data

US 2015/0279601 A1 Oct. 1, 2015

Related U.S. Application Data

(62) Division of application No. 14/004,865, filed as application No. PCT/JP2012/056087 on Mar. 9, 2012, now Pat. No. 9,064,664.

(30) Foreign Application Priority Data

Mar. 22, 2011 (JP) ..... 2011-063368
Oct. 24, 2011 (JP) ..... 2011-232451

(51) Int. Cl.
*H01H 3/00* (2006.01)
*H01H 50/58* (2006.01)
(Continued)

(52) U.S. Cl.
CPC ..... *H01H 50/58* (2013.01); *H01H 1/32* (2013.01); *H01H 50/14* (2013.01); *H01H 50/546* (2013.01);
(Continued)

(58) Field of Classification Search
CPC .... H01H 50/546; H01H 50/14; H01H 50/54; H01H 50/00; H01H 51/065; H01H 51/00; H01H 45/14; H01F 7/1615; H01F 7/202; H01F 2007/068; H01F 2007/083
USPC ..... 335/194
See application file for complete search history.

(56) References Cited

U.S. PATENT DOCUMENTS 4,367,447 A 1/1983 Koehler
5,546,061 A * 8/1996 Okabayashi ..... H01H 9/443 335/126
(Continued)

FOREIGN PATENT DOCUMENTS

JP 57-14347 Y2 3/1982
JP 5-2332 U 1/1993
(Continued)

OTHER PUBLICATIONS

International Search Report issued in PCT/JP2012/056087, dated Apr. 3, 2012, with English translation.
(Continued)

*Primary Examiner* — Shawki S Ismail
*Assistant Examiner* — Lisa Homza
(74) *Attorney, Agent, or Firm* — McDermott Will & Emery LLP

(57) ABSTRACT

Provided is a contact device in which all of three movable contacts can be securely brought into contact with fixed contacts. The contact device includes a fixed terminal 37 that has a fixed contact 35, a movable terminal 28 that moves toward and away from the fixed terminal 37 and has three movable contacts 31*a*, 31*b*, and 31*c* that are brought into contact with the fixed contact 35, and a pressing spring 33 that presses the movable terminal 28 and brings the movable contacts 31*a*, 31*b*, and 31*c* into contact with the fixed contacts 35 at a predetermined pressing force. The point of application of the pressing spring 33 is located in a triangle formed by internal tangents of the three movable contacts.

5 Claims, 13 Drawing Sheets

(51) Int. Cl.

| | |
|---|---|
| ***H01H 1/32*** | (2006.01) |
| ***H01H 50/54*** | (2006.01) |
| ***H01H 51/00*** | (2006.01) |
| ***H01H 50/14*** | (2006.01) |
| ***H01H 50/60*** | (2006.01) |
| *H01H 1/20* | (2006.01) |
| *H01H 1/50* | (2006.01) |
| *H01H 50/30* | (2006.01) |

(52) U.S. Cl.
CPC ..... *H01H 50/60* (2013.01); *H01H 51/00* (2013.01); *H01H 1/20* (2013.01); *H01H 1/50* (2013.01); *H01H 50/305* (2013.01); *H01H 2201/008* (2013.01)

(56) References Cited

U.S. PATENT DOCUMENTS

| | | | |
|---|---|---|---|
| 5,748,061 | A | 5/1998 | Tsutsui et al. |
| 5,805,039 | A | 9/1998 | Smith |
| 5,892,194 | A | 4/1999 | Uotome et al. |
| 6,081,176 | A | 6/2000 | Dittmann et al. |
| 6,911,884 | B2 | 6/2005 | Uotome et al. |
| 7,187,257 | B2 | 3/2007 | Mochizuki et al. |
| 7,385,471 | B2 | 6/2008 | Takeda et al. |
| 7,420,448 | B2 | 9/2008 | Takeda et al. |
| 7,439,834 | B2 | 10/2008 | Mochizuki et al. |
| 7,474,181 | B2 | 1/2009 | Takeda et al. |
| 7,782,162 | B2 | 8/2010 | Nishida |
| 7,817,000 | B2 | 10/2010 | Rauh |
| 7,859,373 | B2 | 12/2010 | Yamamoto et al. |
| 8,222,980 | B2 | 7/2012 | Yamagata et al. |
| 8,228,144 | B2 | 7/2012 | Sugisawa et al. |
| 8,274,345 | B2 | 9/2012 | Sugisawa |
| 8,339,222 | B2 | 12/2012 | Sugisawa |
| 8,525,622 | B2 | 9/2013 | Kubono |
| 2004/0027776 | A1 | 2/2004 | Uotome et al. |
| 2006/0226936 | A1 | 10/2006 | Takeda et al. |
| 2006/0226937 | A1 | 10/2006 | Takeda et al. |
| 2006/0226938 | A1 | 10/2006 | Takeda et al. |
| 2007/0008053 | A1 | 1/2007 | Mochizuki et al. |
| 2007/0241847 | A1 | 10/2007 | Yamamoto et al. |
| 2009/0243771 | A1 | 10/2009 | Uruma et al. |
| 2010/0207713 | A1 | 8/2010 | Sugisawa |
| 2011/0032059 | A1 | 2/2011 | Ito et al. |
| 2011/0241809 | A1 | 10/2011 | Sugisawa et al. |
| 2012/0075044 | A1 | 3/2012 | Sugisawa |
| 2012/0235775 | A1 | 9/2012 | Sugisawa et al. |
| 2012/0256713 | A1 | 10/2012 | Sugisawa et al. |
| 2013/0021122 | A1* | 1/2013 | Uchida ..... H01H 1/54 335/131 |

FOREIGN PATENT DOCUMENTS

| | | | |
|---|---|---|---|
| JP | 2010-257923 | A | 11/2010 |
| JP | 2011-023332 | A | 2/2011 |
| JP | 2011-228245 | A | 11/2011 |

OTHER PUBLICATIONS

United States Office Action issued in U.S. Appl. No. 14/004,865 dated Oct. 10, 2014.

United States Notice of Allowance issued in U.S. Appl. No. 14/004,865 dated Feb. 17, 2015.

* cited by examiner

CONTACT DEVICE

RELATED APPLICATIONS

This application is a Division of application Ser. No. 14/004,865 filed on Sep. 12, 2013, now U.S. Pat. No. 9,046,664, which is the U.S. National Phase under 35 U.S.C. §371 of International Application No. PCT/JP2012/056087, filed on Mar. 9, 2012, which in turn claims the benefit of Japanese Application No. 2011-063368, filed on Mar. 22, 2011, and Japanese Application No. 2011-232451, filed on Oct. 24, 2011, the disclosures of which Applications are incorporated by reference herein.

TECHNICAL FIELD

This invention relates to a contact device in which electric conduction is realized by a movable contact moving toward and coming into contact with a fixed contact.

BACKGROUND ART

Contact devices are used for electromagnetic relays and the like, and a contact device used for an electromagnetic relay is described in JP 2011-23332A. This contact device includes a fixed terminal that has a pair of fixed contacts, a movable contact plate that has a pair of movable contacts and moves toward and away from the fixed terminal, a drive portion configured to move the movable contact plate toward the fixed terminal, a pressing spring that biases the movable contact plate toward the fixed contact, and a case that accommodates these components.

The drive portion includes a shaft that is inserted into the movable contact plate, and a first yoke plate that is provided at one end of the shaft and restricts the movement of the movable contact plate toward the fixed terminal. Meanwhile, a second yoke plate is fixed to the movable contact plate on the opposite side to the movable contacts.

In the contact device, when the shaft moves toward the fixed terminal by the drive of the drive portion, the first yoke plate also moves in the same direction. Therefore, in this case, the movable contact plate moves toward the fixed terminal by the biasing force of the pressing spring, and the movable contacts come into contact with the fixed contacts to allow current to flow. By the flow of current, a magnetic field is generated around the movable contact plate, and a magnetic attractive force is generated between the first yoke plate and the second yoke plate. Since the magnetic attractive force cancels out the repulsive force generated at the contacted region between the contacts, the reduction of the pressing force between the contacts can be mitigated and the movable contacts can be favorably brought into contact with the fixed contacts.

The contact device described above is structured such that the movable contacts that are brought into contact with the fixed contacts are provided as a pair, and the movable contacts are brought into contact with respective fixed contacts by the biasing force of the pressing spring. However, in such a structure in which the movable contacts are provided as a pair, the contact of the movable contacts to the fixed contacts becomes unstable due to the vibration of the movable contact plate under the action of an electromagnetic force caused by the current or external vibration.

Thus, a structure is conceivable in which a movable contact plate is provided with three movable contacts, and the movable contact plate is brought into contact with fixed contacts at three regions. However, in the case where the movable contact plate is brought into contact with the fixed contacts at three regions, there is a problem in that when an acting force on the movable contact plate is localized, it becomes difficult to bring all of the three movable contacts stably into contact at the three regions, and current does not flow stably.

SUMMARY OF INVENTION

Thus, an object of the present invention is to provide a contact device in which a movable contact plate is brought into contact with fixed contacts at three regions that is structured so that all of three movable contacts can be securely brought into (and kept in) contact with corresponding fixed contacts.

A contact device of the present invention includes a plurality of fixed terminals that each include a fixed contact, a movable terminal that moves toward and away from the fixed terminal and that includes three movable contacts to be brought into contact with the fixed contacts, and a pressing spring that presses the movable terminal to bring the movable contacts into contact with the fixed contacts. A point of application of the pressing spring is located in a triangle that is formed by internal tangents of the three movable contacts.

According to this invention, since the point of application of the pressing spring is located in the triangle formed by the internal tangents of the three movable contacts, all of the three movable contacts can be securely brought into (and kept in) contact with corresponding fixed contacts. Thus, the movable contacts and the fixed contacts can be placed in a stable conduction state.

In this contact device, at least two sides of the triangle that is formed by the internal tangents of the three movable contacts may be each tangent to a circle that is centered on the point of application of the pressing spring.

According to the invention, since at least two sides of the triangle that is formed by the internal tangents of the three movable contacts are each tangent to the circle that is centered on the point of application of the pressing spring, all of the movable contacts can be securely brought into (and kept in) contact with corresponding fixed contacts.

In the contact device, the point of application of the pressing spring may be located on a line segment connecting a midpoint of a line segment that connects two vertices of the triangle that is formed by the internal tangents of the three movable contacts with the remaining vertex of the triangle.

According to the invention, the three movable contacts can be more securely brought into (and kept in) contact with corresponding fixed contacts.

In these contact devices, a spring bearing portion may be provided to receive the pressing spring. The center of the force acting on the movable contact plate from the spring bearing portion may be located in the triangle formed by the internal tangents of the three movable contacts.

According to the invention, since the spring bearing portion for receiving the pressing spring is provided, the distances between the three movable contacts can be shortened and the movable contacts can be made larger. Accordingly, all of the movable contacts can be securely brought into (and kept in) contact with the fixed contacts.

Moreover, a contact device of the present invention includes a plurality of fixed terminals that each include a fixed contact, a movable terminal that includes movable contacts, which are brought into contact with and separate from the fixed contacts freely, and moves freely relative to the fixed terminal, and a pressing spring that presses the movable terminal to bring the movable contacts into contact with the fixed contacts. Three contact regions between movable contact and fixed contact are formed on the movable terminal when viewed from a direction in which the movable terminal moves relative to the fixed terminal, and a point of application of the pressing spring is located on a line segment connecting a midpoint of a line segment that connects any two of the three contact regions so that the distance between the two contact regions is the shortest with a point of the remaining contact region at which the distance from the midpoint is the shortest.

That is to say, in the present invention, the spring force center of the pressing spring is located on the line segment, where the line segment connects "the midpoint of the line segment that connects any two of the three contact regions so that the distance between the two contact regions is the shortest" with "a point of the remaining contact region at which the distance from the midpoint is the shortest".

According to the invention, the spring force center of the pressing spring is located in the triangle formed by connecting the three contact regions, and as a result the movable contacts can be securely brought into (and kept in) contact with the fixed contacts at the three contact regions.

Moreover, a contact device of the present invention includes a plurality of fixed terminals that each include a fixed contact, a movable terminal that includes movable contacts, which are brought into contact with and separate from the fixed contacts freely, and moves freely relative to the fixed terminal, and a pressing spring that presses the movable terminal to bring the movable contacts into contact with the fixed contacts. Three contact regions between movable contact and fixed contact are formed on the movable terminal when viewed from a direction in which the movable terminal moves relative to the fixed terminal, and a point of application of the pressing spring is located on a line segment connecting a midpoint of a line segment that connects two vertices of a triangle that is formed by internal tangents of the three contact regions with the remaining vertex of the triangle.

That is to say, in the present invention, the spring force center of the pressing spring is located on the line segment, where the line segment connects "the midpoint of the line segment that connects two vertices of the triangle that is formed by the internal tangents of the three contact regions" with "the remaining vertex of the triangle".

According to the invention, the spring force center of the pressing spring is located in the triangle formed by connecting the three contact regions, and as a result the movable contacts can be more securely brought into (and kept in) contact with the fixed contacts at the three contact regions.

In these contact devices, the movable terminal may have a groove portion that accommodates one end of the pressing spring. At least a part of the line segment may be included in the groove portion when viewed from the direction in which the movable terminal moves relative to the fixed terminal. A contacting portion that includes a contacting face with which the pressing spring comes into contact is formed in the groove portion. The contacting face of the contacting portion may have an arc-shaped cross-section that is centered on the line segment when viewed from a direction of the line segment.

BRIEF DESCRIPTION OF DRAWINGS

Preferred embodiments of the present invention will now be described in further detail. Other features and advantages of the present invention will be more fully understood, taken in conjunction with the following detailed description and attached drawings where.

BEST MODES FOR CARRYING OUT THE INVENTION

In the following, embodiments of the present invention will be described in detail, with reference to diagrams. Note that similar constituent elements are included in the plurality of embodiments described below. Thus, in the following, similar structural elements are provided the same reference sign, and redundant description thereof will be omitted.

(First Embodiment)

Figure 1:
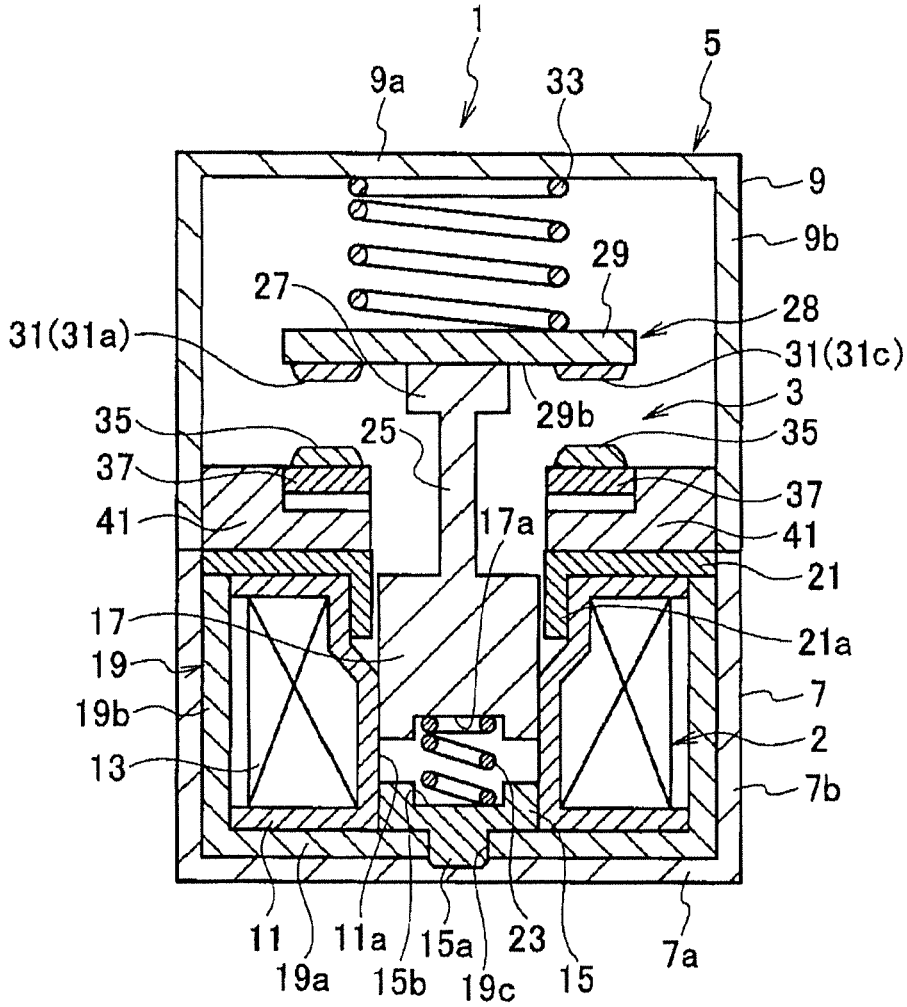
FIG. 1 is a cross-sectional view illustrating a contact device according to a first embodiment of the present invention.
Figure 2:
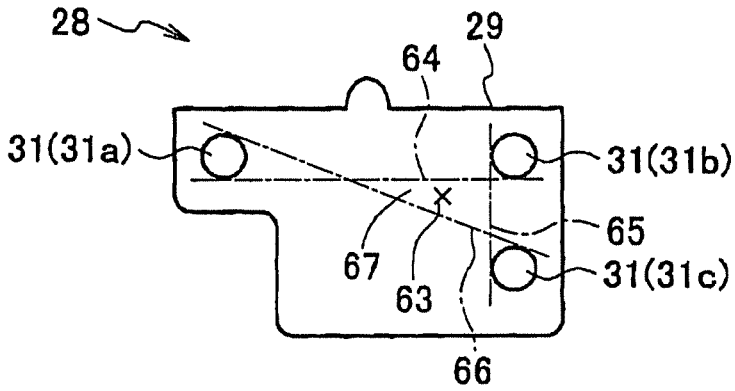
FIG. 2 is a plan view illustrating a movable terminal according to the first embodiment of the present invention.

FIG. 1 illustrates a contact device 1 of a first embodiment of the present invention. FIG. 2 is a plan view of a movable contact plate 28 for illustrating an arrangement of movable contacts 31, 31, 31.

The contact device 1 according to the present embodiment is used for an electromagnetic relay. The contact device 1 includes a drive portion 2 that is located at the lower portion in FIG. 1, and a contact portion 3 that is located at the upper portion, and the drive portion 2 and the contact portion 3 are accommodated in a case 5.

The case 5 includes a drive portion accommodating case 7 that is open on the contact portion 3 side, and a contact portion accommodating case 9 that covers the opening side of the drive portion accommodating case 7. The case 5 may be circular in plan view when viewed from the vertical direction in FIG. 1, or may be a square or a polygonal shape.

The drive portion accommodating case 7 includes a lower wall 7*a*, and a side wall 7*b* that rises toward the contact portion 3 from the circumferential edge of the lower wall 7*a*, and has a cup shape that is open at the contact portion 3 side. Similarly, the contact portion accommodating case 9 includes an upper wall 9*a* and a side wall 9*b* that extends toward the drive portion 2 from the circumferential edge of the upper wall 9*a*, and has a cup shape that is open at the drive portion 2 side.

The drive portion 2 includes a coil 13 that is wound around a coil bobbin 11. Inside a through-hole 11*a* formed at the center of the coil bobbin 11, a stationary core 15 as a fixed member is arranged at the lower wall 7*a* side of the drive portion case 7, and a movable core 17 as a movable member is arranged at the opening side which is the other side of the lower wall 7*a*.

A yoke 19 is arranged between the coil 13 and the drive portion accommodating case 7. The yoke 19 includes a bottom wall 19*a* that faces the lower wall 7*a*, and a tube portion 19*b* that is formed to rise from the circumferential edge of the bottom wall 19*a* and to surround the coil 13, and faces the side wall 7*b*.

A yoke upper plate 21 is arranged to cover a part, which corresponds to a region of the coil 13, of the opening of the yoke 19 at the contact portion 3 side. In the yoke upper plate 21, the outer circumferential edge is fixed to the edge portion of the tube portion 19*b* of the yoke 19, and a tube portion 21*a* that protrudes downward from the inner circumferential edge is inserted between the movable core 17 and the coil bobbin 11. Thus, in the coil bobbin 11, the inner diameter of the through-hole 11*a* is larger at a part of the contact portion 3 side where the tube portion 21*a* of the yoke upper plate 21 is inserted than at other parts in the lower portion.

The stationary core 15 is fixed to the yoke 19 by fitting a protrusion 15*a* to a fitting hole 19*c* formed at the center of the bottom wall 19*a* of the yoke 19. Meanwhile, the movable core 17 located at the contact portion 3 side of the stationary core 15 is able to approach to and separate from the stationary core 15 in the through-hole 11*a* of the coil bobbin 11.

A recess 15*b* and a recess 17*a* are formed respectively at the sides of the stationary core 15 and the movable core 17 that are opposite each other, and a return spring 23 is arranged between these recesses 15*b* and 17*a*. The return spring 23 presses the movable core 17 in the direction of moving away from the stationary core 15 (upward in FIG. 1).

The movable core 17 is provided, on a side opposite thereof from the stationary core 15, with a shaft 25 that extends in the moving direction of the movable core 17. The shaft 25 may be formed integrally with the movable core 17, or may be formed separately and fixed to the movable core 17.

A movable terminal 28 is attached at the tip of the shaft 25 via a boss portion 27.

The movable terminal 28 is formed by a plate-shaped movable contact plate 29 attached to the boss portion 27, and three movable contacts 31(31*a*), 31(31*b*), and 31(31*c*) (see FIG. 2) that are provided to protrude from the lower face of the movable contact plate 29 at the drive portion 2 side. In the present embodiment, the movable contacts 31*a*, 31*b*, and 31*c* are each formed in a circle shape in plan view. However, the shape of the movable contact 31*a*, 31*b*, and 31*c* in plan view is not limited to a circle, and may be another shape such as a square.

In the present embodiment, fixed contacts 35 are arranged to project upward at positions opposite the drive portion 2 sides of the movable contacts 31.

Specifically, three fixed contacts 35, 35, and 35 are arranged so as to project upward at the positions facing the drive portion 2 side surfaces of the three movable contacts 31*a*, 31*b*, and 31*c*. Moreover, the contact device 1 of the present embodiment includes two fixed terminals 37 and 37. Each fixed contact 35 is fixed on one of the two fixed terminals 37 and 37. The fixed terminals 37 and 37 are attached respectively to fixed contact holders 41 and 41 made of insulating resin. The edge portions of the fixed terminals 37 serve as external connection terminals that are extracted from the case 5 and to be connected to an external load or an external power supply.

That is to say, the fixed contacts 35 are provided on the fixed terminals 37 so as to correspond in position and number to the movable contacts 31 on the movable contact plate 29. Since the movable contacts 31 (31*a*, 31*b*, and 31*c*) are provided at three points, the fixed contacts 35, 35, and 35 are provided at three points on the fixed terminals 37 and 37. The movable contacts 31*a*, 31*b*, and 31*c* of the movable contact plate 29 are brought into contact with respective fixed contacts 35, 35, and 35, and by the contact, current is allowed to flow between the fixed contact 35 and the corresponding movable contact 31. Thus, current is allowed to flow between the two fixed terminals 37 and 37 through the movable contact plate 29.

In the present embodiment, one fixed contact 35 is provided at the left side fixed terminal 37 (first fixed terminal) in FIG. 1, and two fixed contacts 35 and 35 are provided at the right side fixed terminal 37 (second fixed terminal) in FIG. 1. The one fixed contact 35 (left-side fixed contact 35 in FIG. 1) provided at the left side fixed terminal 37 (first fixed terminal) is brought into contact with the movable contact 31*a*, and the two fixed contacts 35 and 35 (right-side fixed contact 35 and 35 in FIG. 1) provided at the right side fixed terminal 37 (second fixed terminal) are brought into contact with the movable contact 31*b* and the movable contact 31*c*, respectively. By the contact, current is allowed to flow between the fixed contacts 35 and the corresponding movable contacts 31*a*, 31*b*, and 31*c*.

Note that the number of fixed contacts 35 provided need not be three. For example, one fixed contact 35 with a size that covers both the two movable contacts 31*b* and 31*c* may be provided at the right side fixed terminal 37 (second fixed terminal).

Here, a pressing spring 33 that presses the movable contact plate 29 toward the drive portion 2 side (toward lower side) is arranged between the movable contact plate 29 and the upper wall 9*a* of the contact portion accommodating case 9. In the present embodiment, the pressing spring 33 is formed by a coil spring. Due to the pressing spring 33 pressing the movable contact plate 29, the movable contacts 31*a*, 31*b*, and 31*c* are brought into contact with the respective fixed contacts 35, 35, and 35 with a predetermined pressing force. The spring force of the pressing spring 33 is set to be lower than that of the return spring 23 described above. Thus, in a state in which current is not applied to the coil 13 and the driving force is not provided to the movable core 17, since the elastic force of the return spring 23 overcomes the elastic force of the pressing spring 33, the movable core 17 along with the movable contact plate 29 is moved in the direction away from the stationary core 15 and into the state shown in FIG. 1.

In the present embodiment, as shown in FIG. 2, the movable contact plate 29 is formed in a substantially rectangular plate shape, and the movable contacts 31 are provided on the lower face 29*b* of the movable contact plate 29 such that the three positions are separated from one another. In FIG. 2, reference signs 31*a*, 31*b*, and 31*c* respectively indicate the three movable contacts provided on the movable contact plate 29 so as to form three positions.

Due to one end of the pressing spring 33 being in contact with the upper face of the movable contact plate 29 on which the three movable contacts 31*a*, 31*b*, and 31*c* are provided, the pressing spring 33 presses the movable contact plate 29 toward the fixed terminals 37. The spring force center of the pressing spring 33 at the position in which one end of the pressing spring 33 is in contact acts as the point of application 63 of the pressing spring 33 (see FIG. 2). In other words, the point of application 63 of the pressing spring 33 is the spring force center of the pressing spring 33. In the present embodiment, since the pressing spring 33 is a coil spring, the cross point between the axis of the pressing spring 33 (line of application of pressing spring 33) and the movable contact plate 29 is the point of application 63 of the pressing spring 33. FIG. 2 shows an arrangement of the three movable contacts 31*a*, 31*b*, and 31*c*, and the point of application 63 of the pressing spring 33 of the present embodiment. Thus the three movable contacts 31*a*, 31*b*, and 31*c* are brought into contact with the respective fixed contacts 35, 35, and 35.

In the present embodiment, the point of application 63 of the pressing spring 33 (spring force center of pressing spring 33) is located inside an imaginary triangle formed by the internal tangents of the three movable contacts 31*a*, 31*b*, and 31*c* of the movable contact plate 29. That is to say, as shown in FIG. 2, when three internal tangents 64, 65, and 66 connecting the three movable contacts 31*a*, 31*b*, and 31*c* are drawn, an imaginary triangle 67 is formed by the three internal tangents 64, 65, and 66. The contact device 1 of the present embodiment is configured such that the point of application 63 of the pressing spring 33 is located inside the triangle 67.

Here, the internal tangent of two movable contacts 31 and 31 (first movable contact and second movable contact) is defined as follows.

First, on the face of the movable contact plate 29, lines that come in contact with both the first movable contact and the second movable contact at only one point respectively are determined. In a case where the two movable contacts 31 and 31 are separated circles, as in the present embodiment, the lines are four common tangents of the two circles (two external common tangents and two internal common tangents).

Then, among the lines, the line that divides "a region that includes both the first movable contact and the second movable contact" from "a region that includes the third movable contact" is defined as the internal tangent of the first movable contact and the second movable contact.

In the present embodiment, the shapes of the three movable contacts 31, 31, and 31 are circles in plan view. In this case, "the internal tangent" is defined as an external common tangent formed at the side of the other movable contact 31, among the external common tangents of the two movable contacts 31 and 31.

Thus, the contact device 1 of the present embodiment has a configuration in which the point of application 63 of the pressing spring 33 (spring force center of pressing spring 33) is located inside the triangle 67 formed by the internal tangents 64, 65, and 66 of the three movable contacts 31*a*, 31*b*, and 31*c*. In this configuration, all of the three movable contacts 31*a*, 31*b*, and 31*c* are securely pressed toward the fixed contacts 35 by the pressing spring 33. Thus, the biasing force of the pressing spring 33 securely acts on all the three movable contacts 31*a*, 31*b*, and 31*c*. Thus all of the three movable contacts 31*a*, 31*b*, and 31*c* are securely brought into contact with the respective fixed contacts 35, 35, and 35. Accordingly, the movable contacts 31 (31*a*, 31*b*, and 31*c*) and the fixed contacts 35 can be placed in a stable conduction state. Further, since the point of application 63 of the pressing spring 33 is located inside the triangle 67, the present embodiment can reduce such the likelihood that the movable terminal 28 rotates around a line that connects two movable contacts as an axis. Thus noise of the contact device 1 can be suppressed.

Next, an operation of the contact device 1 will be described.

First, in a state in which current is not applied to the coil 13, as shown in FIG. 1, the elastic force of the return spring 23 overcomes the elastic force of the pressing spring 33, the movable core 17 is moved in the direction away from the stationary core 15 and into the state shown in FIG. 1 in which the movable contacts 31*a*, 31*b*, and 31*c* have separated from the fixed contacts 35, 35, and 35, and as a result the contact device 1 is turned off.

When current is applied to the coil 13 in the off state, the movable core 17 is attracted to the stationary core 15 by the electromagnetic force against the elastic force of the return spring 23, and approaches the stationary core 15. Thus, each movable contact 31 is brought into contact with a corresponding fixed contact 35, and electric conduction between the contacts is realized, and as a result the contact device 1 is turned on.

Thus, in the present embodiment, the vertical direction in FIG. 1 is the moving direction of the movable terminal 28 relative to the fixed terminal 37.

In the operation described above, since the point of application 63 of the pressing spring 33 (spring force center of pressing spring 33) is located inside the triangle 67 formed by the internal tangents 64, 65, and 66 of the three movable contacts 31*a*, 31*b*, and 31*c* of the movable contact plate 29, the biasing force of the pressing spring 33 securely acts on the three movable contacts 31*a*, 31*b*, and 31*c*. As a result, all of the three movable contacts 31*a*, 31*b*, and 31*c* can be securely brought into contact with the respective fixed contacts 35, 35, and 35. Thus, the movable contacts 31 (31*a*, 31*b*, and 31*c*) and the fixed contacts 35 can be put into a stable conduction state. Moreover, since the turning movement of the movable terminal 28 is suppressed, noise of the contact device 1 can be suppressed.

(Second Embodiment)

Figure 3:
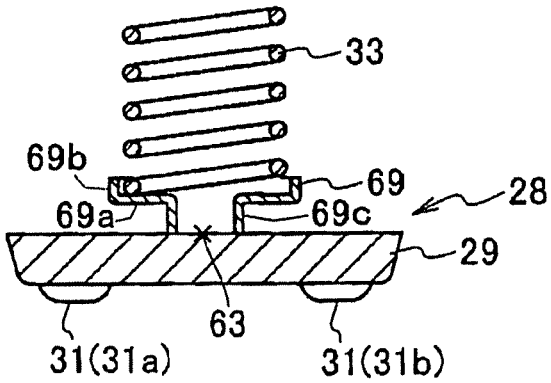
FIG. 3 is a cross-sectional view for describing a spring bearing portion according to a second embodiment of the present invention.

FIG. 3 illustrates a configuration of a movable terminal 28 in a contact device according to a second embodiment of the present invention.

In the present embodiment, a spring bearing portion 69 is provided to a movable contact plate 29. The spring bearing portion 69 is a member to receive a pressing spring 33, and is provided to stand on the upper face of the movable contact plate 29. One end of the pressing spring 33 abuts onto the spring bearing portion 69.

That is to say, in a contact device 1 of the present embodiment, the spring bearing portion 69 that receives one end (lower end) of the pressing spring 33 is provided on the upper face of the movable contact plate 29. The spring bearing portion 69 includes a disk portion 69*a* onto which one end of the pressing spring 33 abuts, a flange portion 69*b* that is provided at the outer circumferential edge of the disk portion 69*a*, and a supporting portion 69*c* that is provided to stand on the upper face of the movable contact plate 29. The disk portion 69*a* is formed in a concentric disk shape with an outer diameter slightly larger than the outer diameter of the pressing spring 33. Note that the disk portion 69*a* may be formed in a disk shape. The flange portion 69*b* is formed in a cylindrical shape that is concentric with the disk portion 69*a*. The flange portion 69*b* has a slightly larger diameter than the outer diameter of the pressing spring 33. The supporting portion 69*c* is formed in a cylindrical shape that is concentric with the disk portion 69*a*. The supporting portion 69*c* has a smaller diameter than the outer diameter of the disk portion 69*a*. One end of the pressing spring 33 is accommodated inside the flange portion 69*b* of the spring bearing portion 69. Thus, the movement of the pressing spring 33 is restricted in the front-back direction and in the right-left direction.

In the present embodiment in FIG. 3, as in the embodiment in FIG. 2, three movable contacts 31(31*a*), 31(31*b*), and 31(31*c*) are provided on the movable contact plate 29. The point of application 63 of the pressing spring 33 (spring force center of pressing spring 33) is located inside the triangle 67 formed by the internal tangents of the three movable contacts 31*a*, 31*b*, and 31*c*. Thus, similar to the situation shown in FIG. 2 of the first embodiment, since the biasing force of the pressing spring 33 securely acts on the three movable contacts 31*a*, 31*b*, and 31*c*, all of the three movable contacts 31*a*, 31*b*, and 31*c* can be securely brought into contact with respective fixed contacts 35, 35, and 35. As a result, the movable contacts 31 (31*a*, 31*b*, and 31*c*) and the fixed contacts 35 can be put into a stable conduction state.

Moreover, in the present embodiment, since the spring bearing portion 69 to receive the pressing spring 33 is provided, the distances among the three movable contacts can be made shorter, and the movable contacts 31 (31*a*, 31*b*, and 31*c*) can be made larger. Since the movable contacts 31 (31*a*, 31*b*, and 31*c*) can be made larger, the contact wear out characteristics during an application of electric load can be improved, and accordingly the lifetime can be improved.

(Third Embodiment)

Figure 4:
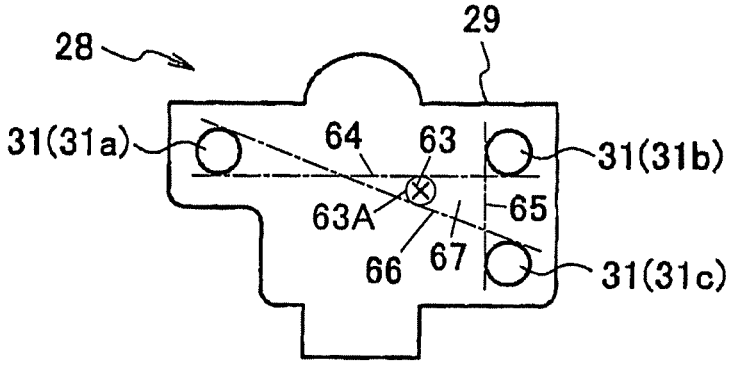
FIG. 4 is a plan view illustrating a movable terminal according to a third embodiment of the present invention.

FIG. 4 illustrates a configuration of a movable terminal 28 according to a contact device of a third embodiment of the present invention.

In the movable terminal 28 of the present embodiment, three movable contacts 31*a*, 31*b*, and 31*c* are provided on a movable contact plate 29 such that a triangle 67 is formed by internal tangents 64, 65, and 66 that connect the three movable contacts 31*a*, 31*b*, and 31*c*. A pressing spring 33 presses the movable contact plate 29, and the pressing spring 33 is arranged such that the point of application 63 is located inside a triangle 67 formed by the internal tangents 64, 65, and 66. Moreover, in the present embodiment, the movable contacts 31*a*, 31*b*, and 31*c* and the pressing spring 33 are arranged such that two sides of the triangle 67 are each tangent to a circle 63A centered on the point of application 63 of the pressing spring 33 (spring force center of pressing spring 33). In FIG. 4, the pressing spring 33 is provided such that a circle 63A centered on the point of application 63 is tangent to the internal tangent 64 that connects the movable contacts 31*a* and 31*b*, and to the internal tangent 66 that connects the movable contacts 31*c* and 31*a*. However, it is not limited to this, and the circle 63A may be provided to be tangent to the internal tangents 64 and 65, or to the internal tangents 65 and 66. Note that a configuration is possible in which an annular (circular arc shaped) end portion at one end of the pressing spring 33 is tangent to the triangle 67.

Thus, since the pressing spring 33 is provided such that two sides of the triangle 67 formed by the internal tangents 64, 65, and 66 for the three movable contacts 31*a*, 31*b*, and 31*c* are each tangent to the circle 63A centered on the point of application 63 of the pressing spring 33, the three movable contacts 31*a*, 31*b*, and 31*c* can be securely brought into contact with corresponding fixed contacts 35, and all the movable contacts 31*a*, 31*b*, and 31*c* can be securely brought into contact with the fixed contacts 35, 35, and 35, respectively.

(Fourth Embodiment)

Figure 5:
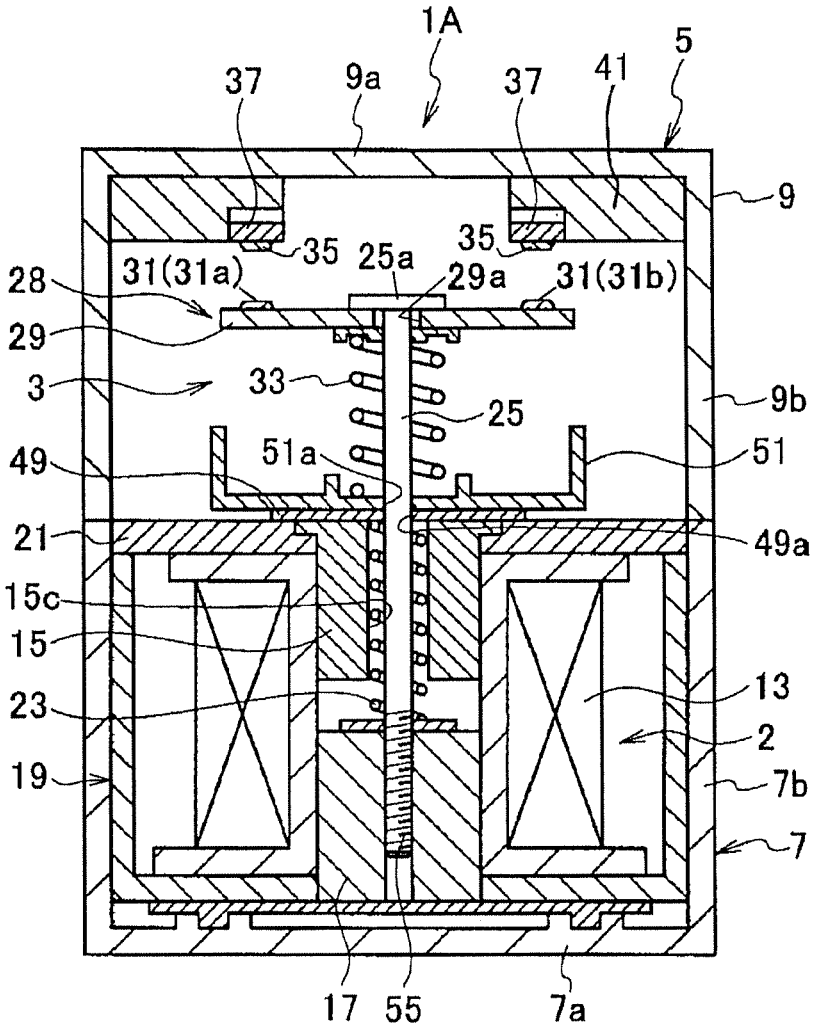
FIG. 5 is a cross-sectional view illustrating a contact device according to a fourth embodiment of the present invention.
Figure 6:
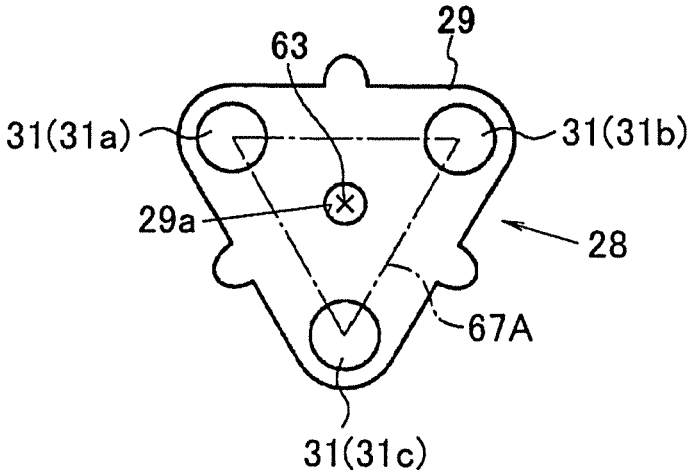
FIG. 6 is a plan view illustrating a movable terminal according to the fourth embodiment of the present invention.
Figure 7:
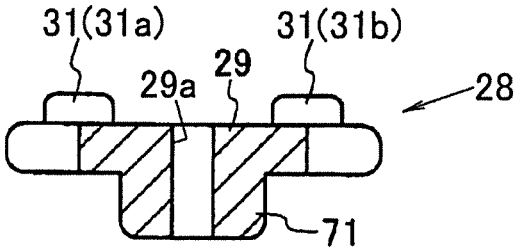
FIG. 7 is a cross-sectional view illustrating the movable terminal according to the fourth embodiment of the present invention.

FIG. 5 illustrates a contact device 1A according to a fourth embodiment of the present invention. FIGS. 6 and 7 illustrate a configuration of a movable terminal 28 of the present embodiment.

In the present embodiment, the movable terminal 28 moves in the direction opposite to the moving direction in the first embodiment in FIG. 1, that is, moves upward in FIG. 5. Fixed contacts 35 corresponding to respective movable contacts 31 are arranged above the movable terminal 28 forwardly in the moving direction of the movable terminal 28.

The positional relation between a stationary core 15 and a movable core 17 is opposite to FIG. 1, and the movable core 17 is arranged at a lower wall 7*a* side in a drive portion case 7. The stationary core 15 is arranged above the movable core 17, and the upper end portion is fixed to a yoke upper plate 21.

The stationary core 15 is provided, at the center thereof, with a through-hole 15*c* that passes through in the moving direction of the movable core 17, and a shaft 25 that is connected to the movable core 17 by screw thread 55 is inserted in the through-hole 15*c*. In the through-hole 15*c*, a return spring 23 that presses the movable core 17 in the direction away from the stationary core 15 is accommodated. The upper end of a return spring 23 is in contact with a presser plate 49 that is fixed to the upper face of a yoke upper plate 21. A spring bearing portion 51 is arranged at a position further above the presser plate 49, and a pressing spring 33 is arranged between the spring bearing portion 51 and a movable contact plate 29. The movable contact plate 29, the presser plate 49, and the spring bearing portion 51 are respectively provided with through-holes 29*a*, 49*a*, and 51*a* in which the shaft 25 is inserted. Moreover, at the upper end of the shaft 25, a flange portion 25*a* that has a larger outer diameter than that of the through-hole 29*a* is provided.

In the present embodiment, in an opposite manner with the first embodiment, movable contacts 31, 31, and 31 are attached to the upper face, which is the opposite side of a drive portion 2, of the movable contact plate 29. Moreover, the contact device 1 of the present embodiment includes two fixed terminals 37 and 37. Then, three fixed contacts 35, 35, and 35 are provided so as to face the respective movable contacts 31, 31, and 31. Each fixed contact 35 is provided at any one of the fixed terminals 37 and 37. The fixed terminals 37 are attached to fixed contact holders 41 provided on an upper wall 9*a* of a contact portion case 9.

Three movable contacts 31(31*a*), 31(31*b*), and 31(31*c*) are provided on the upper face of the movable contact plate 29 at a distance from each other (so as to be separated each other). As shown in FIG. 6, the three movable contacts 31(31*a*), 31(31*b*), and 31(31*c*) are taken as three vertices, and an imaginary triangle 67A is formed by connecting these vertices with line segments. Specifically, the median point of each of the movable contacts 31*a*, 31*b*, and 31*c* taken as a vertex, and the triangle 67A is formed by connecting these vertices with line segments. In the present embodiment, the point of application 63 of the pressing spring 33 (spring force center of pressing spring 33) coincides with the median point of the triangle 67A. The median point is the center of gravity of the triangle 67A formed by the movable contacts 31*a*, 31*b*, and 31*c* as vertices. Thus, due to the point of application 63 of the pressing spring 33 being located at the median point of the triangle 67A, the biasing force of the pressing spring 33 acts on the center of gravity of the triangle 67A. Thus, the biasing force of the pressing spring 33 securely acts on the three movable contact plates 31*a*, 31*b*, and 31*c*, and the three movable contacts 31*a*, 31*b*, and 31*c* are securely brought into contact with the fixed contacts 35, 35, and 35.

Note that, in the present embodiment also, the point of application 63 of the pressing spring 33 (spring force center of pressing spring 33) is located inside a triangle (not shown in FIG. 6) formed by internal tangents (not shown in FIG. 6) of the three movable contacts 31*a*, 31*b*, and 31*c* of the movable contact plate 29.

In addition to the above, in the present embodiment, a portion of the movable contact plate 29 corresponding to the point of application 63 of the pressing spring 33 is made thick, as shown in FIG. 7. Reference sign 71 indicates the thick portion. Since the thick portion 71 corresponds to the median point of the triangle 67A formed by the three movable contacts 31*a*, 31*b*, and 31*c* as vertices, the biasing force of the pressing spring 33 can be focused on the point of application 63 (median point). Thus, the biasing force of the pressing spring 33 can be caused to more securely act on the three movable contacts 31*a*, 31*b*, and 31*c*.

Next, an operation of the contact device 1A will be described.

First, in a state in which current is not applied to a coil 13, shown in FIG. 5, the elastic force of the return spring 23 overcomes the elastic force of the pressing spring 33, the movable core 17 is moved in the direction away from the stationary core 15 and into the state shown in FIG. 5 in which the movable contacts 31*a*, 31*b*, and 31*c* have separated from the fixed contacts 35, 35, and 35, and as a result the contact device 1A is turned off.

When current is applied to the coil 13 in the off state, the movable core 17 is attracted to the stationary core 15 by the electromagnetic force against the elastic force of the return spring 23, and approaches the stationary core 15. Thus, the flange portion 25*a* and the movable contact plate 29 move upward, each movable contact 31 is brought into contact with a corresponding fixed contact 35, and electric conduction between the contacts is realized, and as a result the contact device 1A is turned on.

Thus, in the present embodiment, the vertical direction in FIG. 5 is the moving direction of the movable terminal 28 relative to the fixed terminal 37.

In the present embodiment, since the point of application 63 of the pressing spring 33 (spring force center of pressing spring 33) coincides with the median point of the triangle 67A formed by the three movable contacts 31*a*, 31*b*, and 31*c*, the biasing force of the pressing spring 33 acts securely on the three movable contacts 31*a*, 31*b*, and 31*c*. Thus, the three movable contacts 31*a*, 31*b*, and 31*c* can be securely brought into contact with the fixed contacts 35, 35, and 35.

(Fifth Embodiment)

Figure 8:
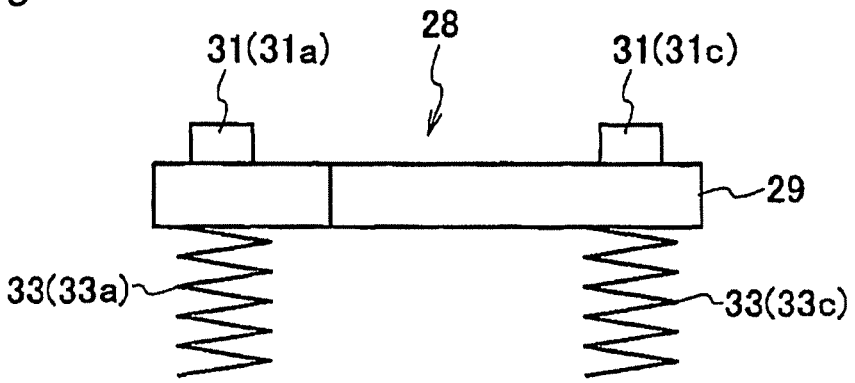
FIG. 8 is a side view illustrating a movable terminal according to a fifth embodiment of the present invention.
Figure 9:
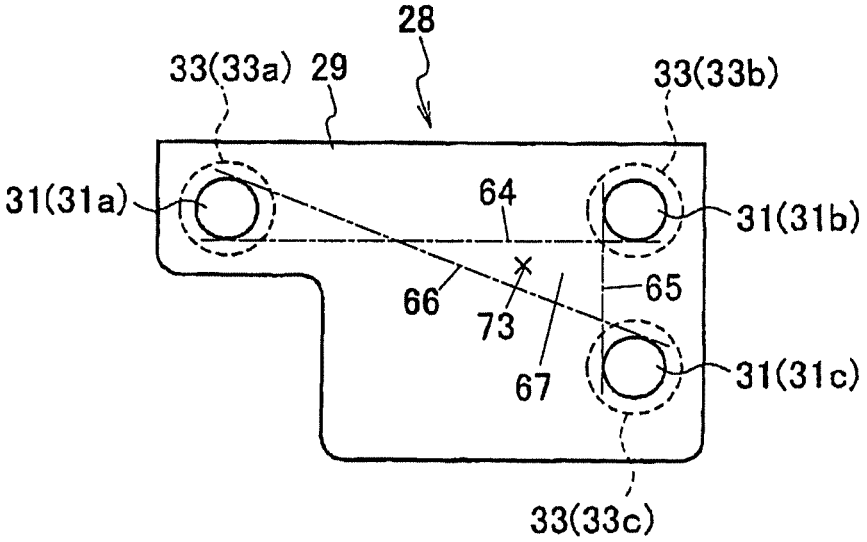
FIG. 9 is a plan view illustrating the movable terminal according to the fifth embodiment of the present invention.

FIGS. 8 and 9 illustrate configurations of a movable terminal 28 and pressing springs 33, 33, and 33 in a contact device of a fifth embodiment of the present invention. The movable terminal 28 and the pressing springs 33, 33, and 33 may be used in the contact device IA shown in FIG. 5. Note that, in FIG. 9, an illustration of a through-hole 29*a* is omitted.

In the present embodiment, the three pressing springs 33, 33, and 33 are provided corresponding to three movable contacts 31*a*, 31*b*, and 31*c* that are provided at a movable contact plate 29. That is to say, the pressing spring 33*a* is provided corresponding to the movable contact 31*a*, the pressing spring 33*b* is provided corresponding to the movable contact 31*b*, and the pressing spring 33*c* is provided corresponding to the movable contact 31*c*. These pressing springs 33*a*, 33*b*, and 33*c* are provided at the movable contact plate 29 to be located under the corresponding movable contacts 31*a*, 31*b*, and 31*c*. That is to say, the pressing springs 33*a*, 33*b*, and 33*c* are respectively provided at the other side of the movable contact plate 29 to the movable contacts 31*a*, 31*b*, and 31*c* (see FIGS. 8 and 9). The pressing springs 33*a*, 33*b*, and 33*c* bias the movable contact plate 29 such that the movable contact plate 29 moves toward the fixed contacts 35. The pressing spring 33*a*, 33*b*, and 33*c* bias the movable terminal 28 in the same direction (upward in FIG. 8).

The three pressing springs 33*a*, 33*b*, and 33*c* are configured such that the combined point of application of these springs is located inside a triangle 67 formed by internal tangents 64, 65, and 66 of the three movable contacts 31*a*, 31*b*, and 31*c*. In the present embodiment, the combined point of application is defined as a point at which the sum of the moments generated by the three pressing springs 33*a*, 33*b*, and 33*c* is 0. That is to say, by depicting three internal tangents 64, 65, and 66 that connect the three movable contacts 31*a*, 31*b*, and 31*c* as shown in FIG. 9, a triangle 67 is formed by the three internal tangents 64, 65, and 66. In the present embodiment, the combined point of application 73 of the three pressing springs 33*a*, 33*b*, and 33*c* is located inside the triangle 67. In other words, the spring constants and positions of the three pressing spring 33*a*, 33*b*, and 33*c* are set such that the combined point of application 73 is located inside the triangle 67 defined by the three internal tangents 64, 65, and 66.

Thus, by locating the combined point of application 73 of the three pressing springs 33 inside the triangle 67 formed by the internal tangents 64, 65, and 66 of the three movable contacts 31*a*, 31*b*, and 31*c*, the biasing force that combines the three pressing springs 33*a*, 33*b*, and 33*c* acts securely on the three movable contacts 31*a*, 31*b*, and 31*c*. Thus, all of the three movable contacts 31*a*, 31*b*, and 31*c* can be securely brought into contact with the respective fixed contacts 35, 35, and 35, and the movable contacts 31 (31*a*, 31*b*, and 31*c*) and the fixed contacts 35 can be put into stable conduction state.

(Sixth Embodiment)

Figure 10:
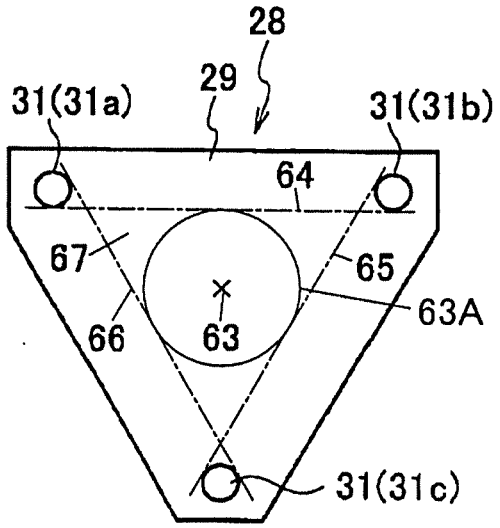
FIG. 10 is a plan view illustrating a movable terminal according to a sixth embodiment of the present invention.

FIG. 10 illustrates a configuration of a movable terminal 28 in a contact device in a sixth embodiment of the present invention. The movable terminal 28 may be used in the contact device 1A shown in FIG. 5, for example. Note that, in FIG. 10 also, an illustration of a through-hole 29*a* is omitted.

In the present embodiment, three movable contacts 31*a*, 31*b*, and 31*c* are arranged in a substantially equilateral triangular shape on a movable contact plate 29. Meanwhile, one pressing spring 33 is arranged in relation to the movable contact plate 29, and biases the movable contact plate 29. The pressing spring 33 is provided at a position in which a circle 63A centered on the point of application 63 of the pressing spring 33 inscribes a triangle 67 formed by the three movable contacts 31*a*, 31*b*, and 31*c*. That is to say, the triangle 67 is formed by internal tangents 64, 65, and 66 that connect the three movable contacts 31*a*, 31*b*, and 31*c*, the pressing spring 33 is provided at a position in which the circle 63A centered on the point of application 63 (spring force center) inscribe to the triangle 67 formed by the internal tangents 64, 65, and 66, and the internal tangents 64, 65, and 66 are each tangent to the circle 63A centered on the point of application 63. Note that, an end portion in a circular ring (circular arc) shape at one end of the pressing spring 33 may inscribe the three sides of the triangle 67.

Thus, due to the circle 63A centered on the point of application 63 of the pressing spring 33 being provided at the position in which the circle 63A inscribe to the triangle 67 formed by the three movable contacts 31*a*, 31*b*, and 31*c*, the biasing force of the pressing spring 33 securely acts on the three movable contacts 31*a*, 31*b*, and 31*c*, and the three movable contacts 31*a*, 31*b*, and 31*c* can be securely brought into contact with fixed contacts 35, 35, and 35.

(Seventh Embodiment)

Figure 11:
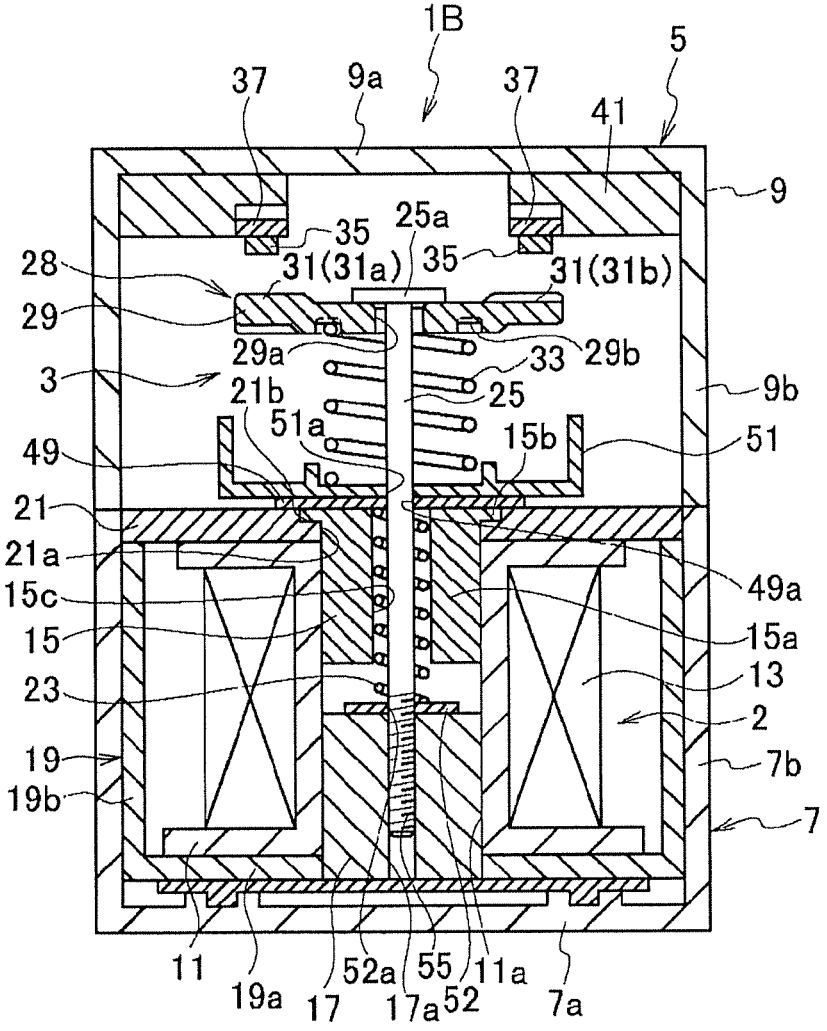
FIG. 11 is a cross-sectional view illustrating a contact device according to a seventh embodiment of the present invention.

FIG. 11 illustrates a contact device 1B in a seventh embodiment of the present invention. FIGS. 12 to 18 illustrate a movable terminal 28 of the present embodiment. The contact device 1B of the present embodiment has a similar configuration with the contact device 1A shown in FIG. 5, and only the configuration of a movable terminal 28, and the like differ.

The contact device 1B according to the present embodiment is used for an electromagnetic relay. The contact device 1B includes a drive portion 2 that is located at a lower portion in FIG. 11, and a contact portion 3 that is located at an upper portion, and these drive portion 2 and contact portion 3 are accommodated in a case 5.

The case 5 includes a drive portion accommodating case 7 that is open at the contact portion 3 side, and a contact portion accommodating case 9 that covers the opening side of the drive portion accommodating case 7. The case 5 may be a circle in plan view when viewed from the vertical direction in FIG. 11, or may be a square or a polygonal shape.

The drive portion accommodating case 7 includes a lower wall 7*a*, and a side wall 7*b* that rises toward the contact portion 3 from the circumferential edge of the lower wall 7*a*, and has a cup shape that is open at the contact portion 3 side. Similarly, the contact portion accommodating case 9 includes an upper wall 9*a* and a side wall 9*b* that extends toward the drive portion 2 from the circumferential edge of the upper wall 9*a*, and has a cup shape that is open at the drive portion 2 side.

The drive portion 2 includes a coil 13 that is wound around a coil bobbin 11. Inside a through-hole 11*a* formed at the center of the coil bobbin 11, a stationary core 15 as a fixed member is arranged at the opening side of the drive portion case 7, and a movable core 17 as a movable member is arranged at the lower wall 7*a* side which is a side opposite thereof from the opening.

A yoke 19 is arranged between the coil 13 and the drive portion accommodating case 7. The yoke 19 includes a bottom wall 19*a* that faces the lower wall 7*a*, and a tube portion 19*b* that is formed to rise from the circumferential edge of the bottom wall 19*a* and to surround the coil 13, and faces the side wall 7*b*.

A yoke upper plate 21 is arranged to cover the opening of the yoke 19 at the contact portion 3 side at a part corresponding to the coil 13.

The stationary core 15 is fixed to the yoke upper plate 21 and the coil bobbin 11, by fitting a protrusion 15*a* to a through-hole 21*a* of the yoke upper plate 21 and a through-hole 11*a* of the coil bobbin 11, and by placing a flange portion 15*b* on a bearing surface 21*b* formed at the upper portion of the yoke upper plate 21. Meanwhile, the movable core 17 located at the lower wall 7*a* side of the stationary core 15 moves to and away from the stationary core 15 freely in the through-hole 11*a* of the coil bobbin 11.

The stationary core 15 and the movable core 17 are respectively provided with a through-hole 15*c* and a through-hole 17*a*, and a return spring 23 is arranged between the stationary core 15 and the movable core 17. The return spring 23 presses the movable core 17 in the direction away from the stationary core 15 (downward in FIG. 11) through a spring bearing portion 52.

The upper end of the return spring 23 is in contact with a presser plate 49 fixed to the upper face of the yoke upper plate 21. A spring bearing portion 51 is arranged at a position further above the presser plate 49, and a pressing spring 33 is arranged between the spring bearing portion 51 and a movable contact plate 29 to be described.

Moreover, a shaft 25 that extends in the moving direction of the movable core 17 is provided at the movable core 17, and the movable terminal 28 is arranged at the upper end side of the shaft 25. The movable terminal 28 is provided with a through-hole 29*a*, and the shaft 25 is inserted into the through-hole 29*a*. The movable terminal 28 is formed by the plate-shaped movable contact plate 29, and three movable contacts 31(31*a*), 31(31*b*), and 31(31*c*) that are provided to protrude from the upper face of the movable contact plate 29 (see FIG. 12). The three movable contacts 31*a*, 31*b*, and 31*c* are formed on the upper face of the movable contact plate 29 at a distance from each other.

Moreover, in the present embodiment, screw thread 55 is formed at one end (lower end) of the shaft 25, and a flange portion 25*a* is formed at the other end (upper end). The presser plate 49, the spring bearing portions 51 and 52, and the movable contact plate 29 are respectively provided with a through-hole 49*a*, through-holes 51*a* and 52*a*, and the through-hole 29*a* in which the shaft 25 is inserted.

The movable terminal 28 is arranged at the upper end side of the shaft 25 in the following way.

First, as shown in FIG. 11, the movable core 17, the spring bearing portion 52, the return spring 23, the presser plate 49, the spring bearing portion 51, the pressing spring 33, and the movable terminal 28 are arranged in order from the bottom. Here, the return spring 23 is inserted in the through-hole 15*c* of the stationary core 15 of which the protrusion 15*a* is fitted to the through-hole 21*a* of the yoke upper plate 21 and the through-hole 11*a* of the coil bobbin 11.

Then, the screw thread 55 side of the shaft 25 is inserted from above the movable terminal 28 in the through-holes 29*a*, 51*a*, and 49*a*, the pressing spring 33, and the return spring 23, and is connected to the movable core 17 through the screw thread 55.

Thus, the movable terminal 28 can be arranged at the upper end side of the shaft 25. Note that, in the present embodiment, an annular groove portion 29*b* is formed on the lower face of the movable contact plate 29, and one end of the pressing spring 33 is accommodated in the groove portion 29*b*. The movable terminal 28 is biased upward by the pressing spring 33.

In the present embodiment, two fixed contacts 35 and 35 are arranged to protrude downward at positions opposite the three movable contacts 31*a*, 31*b*, and 31*c*. Moreover, the contact device 1B of the present embodiment includes two fixed terminals 37 and 37.

Each fixed contact 35 is fixed to one of the two fixed terminals 37 and 37. The fixed terminals 37 and 37 are attached respectively to fixed contact holders 41 and 41 made of insulating resin. Note that, the edge portions of the fixed terminals 37 serve as external connection terminals that are extracted from the case 5 and to be connected to an external load or an external power supply.

In the present embodiment, two (a plurality of) fixed contacts 35 and 35 are provided at the fixed terminals 37 and 37. In other words, one (first) fixed contact 35 is provided at one fixed terminal 37, and one (second) fixed contact 35 is provided at the other fixed terminal 37. Then, one fixed contact 35 (left side fixed contact 35 in FIG. 11: first fixed contact 35) is brought into contact with the movable contact 31*a*, and the other fixed contact 35 (right side fixed contact 35 in FIG. 11: second fixed contact 35) is brought into contact with the movable contact 31*b* and the movable contact 31*c*. By the contact, current is allowed to flow between the fixed contacts 35 and the corresponding movable contacts 31*a*, 31*b*, and 31*c*.

Here, due to the pressing spring 33 pressing the movable contact plate 29, the movable contacts 31*a*, 31*b*, and 31*c* are brought into contact with the corresponding fixed contacts 35 with a predetermined pressing force. The spring force of the pressing spring 33 is set to be lower than that of the return spring 23 described above. Thus, in a state in which current is not applied to the coil 13 and the driving force is not provided to the movable core 17, since the elastic force of the return spring 23 overcomes the elastic force of the pressing spring 33, the movable core 17 along with the movable contact plate 29 is moved to the direction away from the stationary core 15 (downward in FIG. 11) and into the state shown in FIG. 11.

Next, an operation of the contact device 1B will be described.

First, in a state shown in FIG. 11 in which current is not applied to the coil 13, the elastic force of the return spring 23 overcomes the elastic force of the pressing spring 33, the movable core 17 is moved in the direction away from the stationary core 15 and into the state shown in FIG. 11 in which the movable contacts 31*a*, 31*b*, and 31*c* have separated from the fixed contacts 35, 35, and 35, and as a result the contact device 1B is turned off.

When current is applied to the coil 13 in the off state, the movable core 17 is attracted to the stationary core 15 by the electromagnetic force against the elastic force of the return spring 23, and approaches the stationary core 15. Thus, each movable contact 31 is brought into contact with a corresponding fixed contact 35, and electric conduction between the contacts is realized, and as a result the contact device 1B is turned on.

Thus, in the present embodiment, the vertical direction in FIG. 11 is the moving direction of the movable terminal 28 relative to the fixed terminal 37.

Here, in the present embodiment, the pressing portion of the movable terminal 28 by the pressing spring 33 is set such that the spring force center x of the pressing spring 33 (point of application of pressing spring 33) is located inside an imaginary triangle T1 formed by connecting the three movable contacts 31*a*, 31*b*, and 31*c*.

Figure 14:
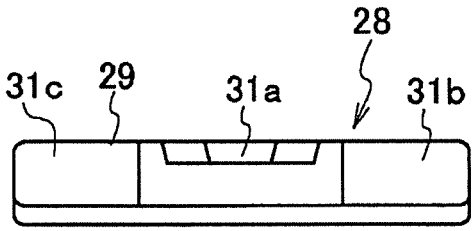
FIG. 14 is a side view illustrating the movable terminal according to the seventh embodiment of the present invention.

Specifically, the movable contact plate 29 of the movable terminal 28 is formed in a substantially trapezoidally-shaped plate, and the three movable contacts 31*a*, 31*b*, and 31*c* are provided on the movable contact plate 29 at three positions separated from each other. In the present embodiment, the substantially trapezoidally-shaped movable contact 31*a* is formed by protruding upward the center portion in the width direction (vertical direction in FIG. 12) at one end side in the longitudinal direction (left side in FIG. 12: short side of movable contact plate 29) of the movable contact plate 29 in a substantially trapezoidally shape. Then, the substantially pentagon-shaped movable contacts 31*b* and 31*c* are formed by protruding upward both end portions in the width direction at the other end side in the longitudinal direction (right side in FIG. 12: long side of movable contact plate 29) of the movable contact plate 29 in a substantially pentagon shape. FIG. 14 is a side view of the movable terminal 28 when viewed from the right side in FIG. 12.

Moreover, the through-hole 29*a* into which the shaft 25 described above is inserted is formed at the center portion in the longitudinal direction of the movable contact plate 29, that is between the movable contact 31*a* at one side and the movable contacts 31*b* and 31*c* at the other side. Also, the circular ring shaped groove portion 29*b* is formed on the lower face of the movable contact plate 29 to be approximately concentric with the through-hole 29*a*.

Figure 12:
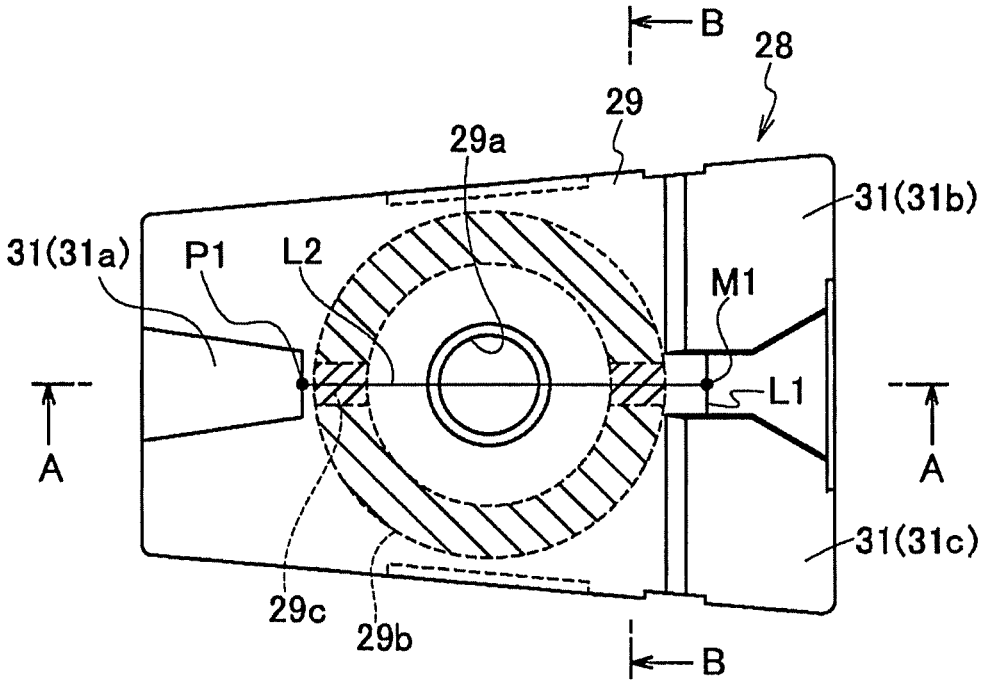
FIG. 12 is a plan view illustrating a movable terminal according to the seventh embodiment of the present invention.
Figure 13:
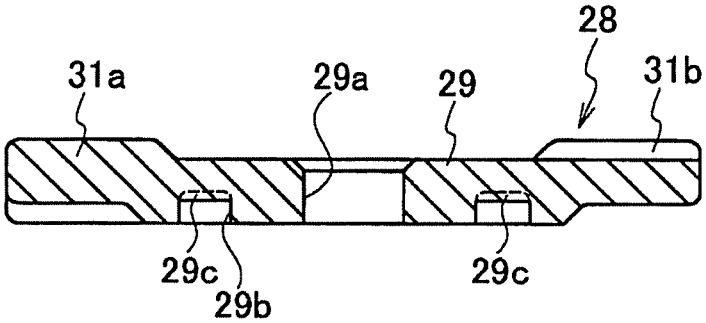
FIG. 13 is a longitudinal section taken along line A-A in FIG. 12.

Also, at both ends of the circular ring shaped groove portion 29*b* in the longitudinal direction of the movable contact plate 29, protrusions (contacting portion) 29*c* and 29*c* are provided protruding downward (see FIGS. 12 and 13). Thus, one end of the pressing spring 33 accommodated in the groove portion 29*b* is in contact with only the protrusions (contacting portions) 29*c* and 29*c*. In other words, it is configured such that the pressing spring 33 is not in contact with portions on the inner face of the groove portion 29*b* other than the portions where the protrusions (contacting portion) 29*c* and 29*c* are formed.

Thus, the spring force center x of the pressing spring 33 is located at the intermediate portion between the two protrusions (contacting portion) 29*c* and 29*c*, that is, almost at the center of the groove portion 29*b*.

Moreover, the fixed contact 35 is provided so as to be a substantially columnar shape, the fixed contact 35 at one end side in the longitudinal direction (left side fixed contact 35 in FIG. 11) of the movable contact plate 29 is brought into contact with the movable contact 31*a*, and the fixed contact 35 at the other end side in the longitudinal direction (right side fixed contact 35 in FIG. 11) of the movable contact plate 29 is brought into contact with the movable contacts 31*b* and 31*c*.

Figure 17:
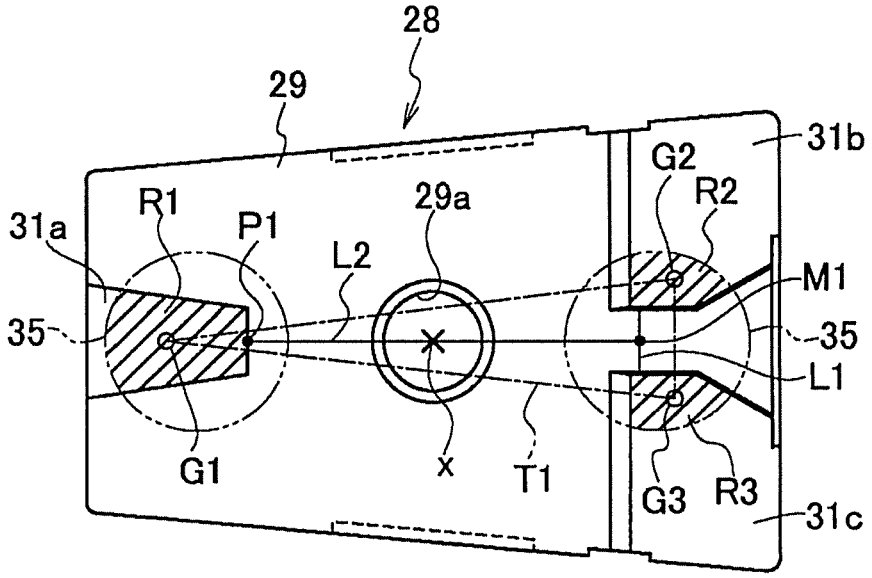
FIG. 17 is a diagram illustrating a contact state between movable contacts and fixed contacts according to the seventh embodiment of the present invention, and is a plan view illustrating a contact state between the movable contacts and the fixed contacts when the movable terminal is in a normal state.

Therefore, when viewed from the vertical direction (moving direction of movable terminal 28 relative to fixed terminal 37), three contact regions R1, R2, and R3 between movable contact 31*a*, 31*b*, 31*c* and fixed contact 35, 35 are formed on the movable terminal 28. Note that the contact regions R1, R2, and R3 are overlapping regions (hatched areas in FIG. 17) between the movable contacts 31*a*, 31*b*, and 31*c* and the fixed contacts 35 and 35, when viewed from the vertical direction in the normal state of the movable terminal 28. As shown in FIG. 17, a triangle T1 is formed by connecting the median points G1, G2, and G3 of the respective contact regions R1, R2, and R3.

In the present embodiment, as shown in FIG. 17, the spring force center x of the pressing spring 33 (point of application of pressing spring 33) is set to be located inside the triangle T1 formed by connecting the three movable contacts 31*a*, 31*b*, and 31*c*.

That is to say, in the present embodiment, the spring force center x of the pressing spring 33 (point of application of pressing spring 33) is set to be located on a line segment L2 in FIG. 17.

The line segment L2 is a line segment depicted as follows.

First, a line segment L1 is defined as a line segment that connects any two of the three contact regions R1, R2, and R3 (in the present embodiment, the contact regions R2 and R3 that are brought into contact with one fixed contact 35) such that the distance between the contact regions R2 and R3 is the shortest. Here, the midpoint of the line segment L1 is referred to as a midpoint M1. A point P1 is defined as a point in which the distance between the remaining contact region R1 and the midpoint M1 is the shortest. The line segment L2 is depicted by connecting the midpoint M1 and the point P1.

The spring force center x of the pressing spring 33 is located on the line segment L2 depicted in the way described above.

Note that, in the present embodiment, the movable terminal 28 is formed so as to be line-symmetric with respect to the line segment L2, and therefore the triangle T1 is an isosceles triangle and the line segment L2 passes the median point of the triangle T1.

Here, the position setting of the spring force center x of the pressing spring 33 is performed as follows.

First, when viewed from the direction in which the movable terminal 28 moves relative to the fixed terminal 37, a groove portion 29*b* is formed so as to include at least a part of a line that includes the line segment L2. In the present embodiment, the circular ring-shaped groove portion 29*b* is formed such that the line that includes the line segment L2 passes the center. Here, the groove portion 29*b* is divided into two by the line segment L2.

Then, when viewed from the direction in which the movable terminal 28 moves relative to the fixed terminal 37, protrusions (contacting portion) 29*c* and 29*c* that come into contact with one end of the pressing spring 33 are formed in the region that includes the line segment L2 and in the groove portion 29*b*.

The cross-section of a contacting face 29*d* of the protrusion (contacting portion) 29*c* that comes into contact with one end of the pressing spring 33 is formed in an arch shape that is centered on the line that includes the line segment L2 when viewed from the direction of the line segment L2.

Figure 15:
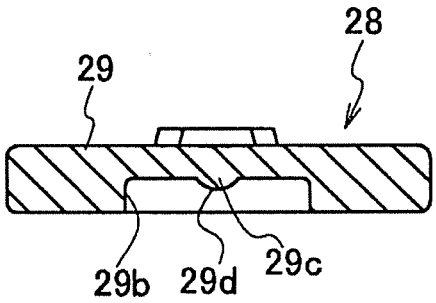
FIG. 15 is a longitudinal section taken along line B-B in FIG. 12.
Figure 16:
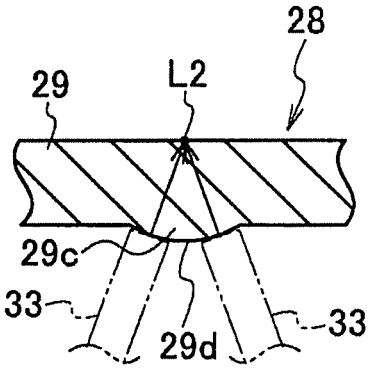
FIG. 16 is a diagram illustrating a contact state between a contacting portion and a pressing spring according to the seventh embodiment of the present invention.

In the present embodiment, the protrusion (contacting portion) 29*c* is formed of a part of a column the axis of which corresponds to the line segment L2 (see FIGS. 15 and 16: note that, FIG. 15 is a cross-sectional view taken along B-B in FIG. 12).

Thus, when one end of the pressing spring 33 comes into contact with the contacting faces 29*d* of the protrusions (contacting portions) 29*c*, both of the pressing directions of the two spring forces of the pressing spring 33 pass through the line segment L2 (see FIG. 16), as a result, the spring force center x of the pressing spring 33 is located on the line segment L2.

As described above, in the present embodiment, the spring force center x of the pressing spring 33 is located on the line segment L2 connecting the midpoint M1 of the line segment Li that connects any two of the three contact regions R1, R2, and R3 so that the distance between the contact regions R2 and R3 is the shortest with the point P1 of the remaining contact region R1 at which the distance between the contact region R1 and the midpoint Ml is the shortest.

Thus, by setting the position of the spring force center x of the pressing spring 33 to be on the line segment L2, the spring force center x of the pressing spring 33 is located in the triangle T1 that is formed by connecting the three movable contacts 31*a*, 31*b*, and 31*c*.

Incidentally, if the spring force center x of the pressing spring 33 (point of application of pressing spring 33) is located outside the triangle T1, when the movable contacts 31*a*, 31*b*, and 31*c* are brought into contact with the fixed contacts 35 and 35, the movable terminal 28 may turn in the direction in which one of the movable contacts moves away from the fixed contact 35 due to the pressing pressure to the movable terminal 28 by the pressing spring 33. Thus, there is a problem in that it becomes difficult for all of the three movable contacts 31*a*, 31*b*, and 31*c* to be brought into contact with the fixed contacts 35, and current does not flow stably. Moreover, there is also a problem in that due to the turning movement of the movable terminal 28, there is an increase in the vibration of the movable terminal 28 and noise, when the contact device 1B is turned on.

However, in the present embodiment, the spring force center x of the pressing spring 33 is located in the triangle T1. Thus, all of the three movable contacts 31*a*, 31*b*, and 31*c* can be pressed toward the fixed contacts 35 by the pressing spring 33, and all of the three movable contacts 31*a*, 31*b*, and 31*c* can be more securely brought into contact with corresponding fixed contacts 35. That is to say, the movable contacts 31*a*, 31*b*, and 31*c* and the fixed contacts 35 and 35 can be more securely brought into contact with each other in the three contact regions R1, R2, and R3. Moreover, since the turning movement of the movable terminal 28 is suppressed, noise of the contact device 1B can be suppressed.

Figure 18:
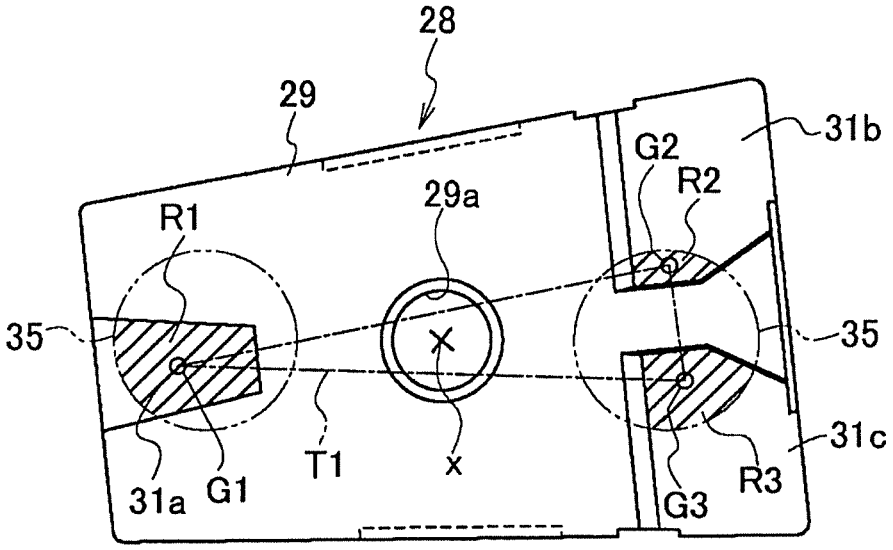
FIG. 18 is a diagram describing a state in which the movable contacts are in contact with the fixed contacts according to the seventh embodiment of the present invention, and is a plan view illustrating a state in which the movable contacts are in contact with the fixed contacts when the movable terminal is displaced.

Moreover, in the present embodiment, the position of the spring force center x of the pressing spring 33 is set on the line segment L2. Thus, as shown in FIG. 18, even if the movable terminals 28 are brought into contact with the fixed contacts 35 and 35 in a state in which the movable terminal 28 has been displaced (has turned), the spring force center x of the pressing spring 33 can be located in the triangle T1.

That is to say, according to the present embodiment, the allowable range for the displacement of the movable terminal 28 can be made wider. Specifically, as long as all of the three movable contacts 31*a*, 31*b*, and 31*c* are brought into contact with the fixed contacts 35 and 35, the spring force center x of the pressing spring 33 can be located in the triangle T1. Thus, all of the three movable contacts 31*a*, 31*b*, and 31*c* can be even more securely brought into contact with the fixed contacts 35 and 35.

Moreover, in the present embodiment, the groove portion 29*b* in which one end of the pressing spring 33 is accommodated is formed in the movable terminal 28.

Then, when viewed from the direction in which the movable terminal 28 moves relative to the fixed terminal 35, at least a part of the line segment L2 is included in the groove portion 29*b*.

The protrusions (contacting portions) 29*c* and 29*c* that have the contacting face 29*d* with which the pressing spring 33 comes into contact are formed in the groove portion 29*b*.

The cross-section of the contacting face 29*d* of the protrusions (contacting portions) 29*c* is formed in an arch shape that is centered on the line segment L2 when viewed from the direction of the line segment L2.

Thus, by forming the protrusions (contacting portions) 29*c*, regardless of the part of the contacting face 29*d* with which the pressing spring 33 comes into contact, the pressing direction of the spring force of the pressing spring 33 passes through the line segment L2. Accordingly, the displacement of the spring force center x of the pressing spring 33 caused by a contact between the pressing spring 33 and the contacting face 29*d* in a displaced state can be suppressed as much as possible, and, as a result, all of the three movable contacts 31*a*, 31*b*, and 31*c* can be even more securely brought into contact with the fixed contacts 35 and 35.

(Eighth Embodiment)

A contact device 1C according to the present embodiment has almost the same configuration with the first embodiment, and is used for an electromagnetic relay.

Figure 19:
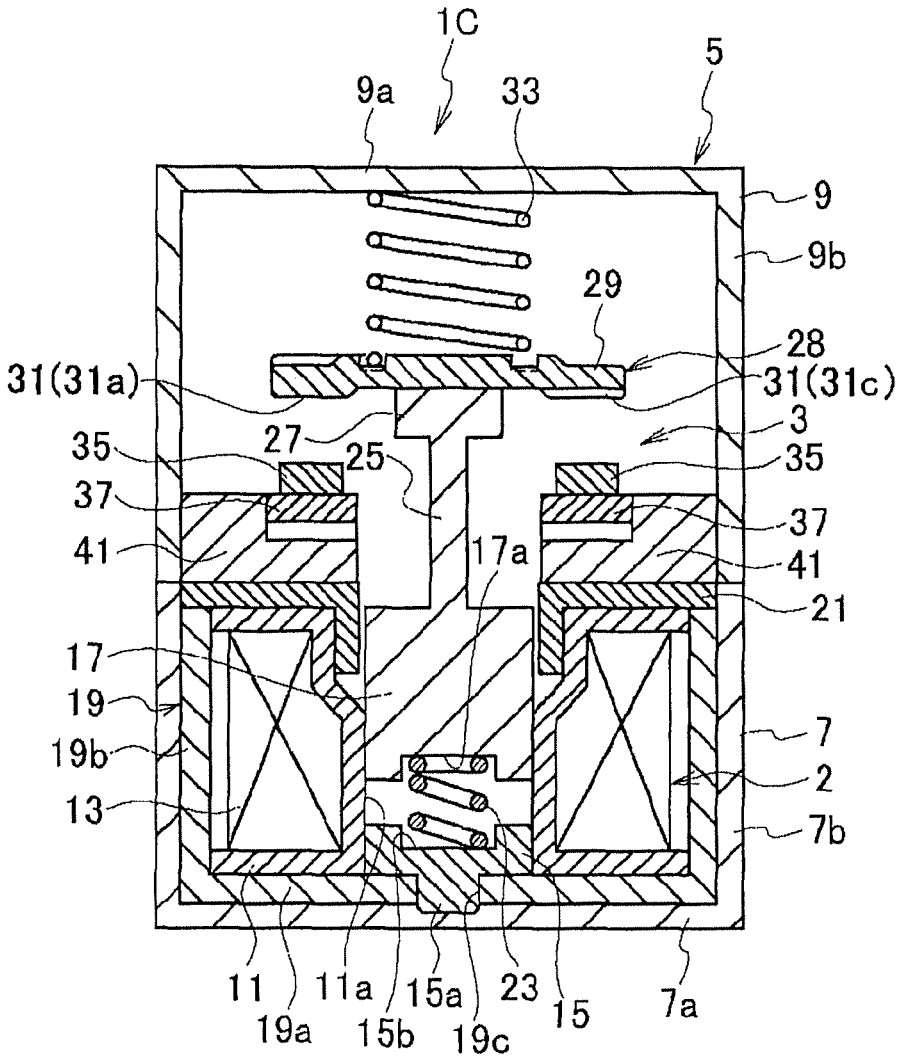
FIG. 19 is a cross-sectional view illustrating a contact device according to an eighth embodiment of the present invention.

That is to say, the contact device 1C of the present embodiment includes a drive portion 2 that is located at a lower portion in FIG. 19, and a contact portion 3 that is located at an upper portion, and the drive portion 2 and the contact portion 3 are accommodated in a case 5.

Note that, since the configuration of the case 5 and the drive portion 2 is similar to the first embodiment, detailed description will be omitted.

A movable terminal 28 of the present embodiment has almost the same configuration with the movable terminal 28 of the seventh embodiment described above. The movable terminal 28 of the present embodiment is attached to the tip of a shaft 25 via a boss portion 27.

The movable terminal 28 is formed by a plate-shaped movable contact plate 29 that is attached to the boss portion 27, and three movable contacts 31(31*a*), 31(31*b*), and 31(31*c*) (see FIG. 12) that are provided to protrude from the lower face at the drive portion 2 side of the movable contact plate 29. That is to say, in the present embodiment, the movable terminal 28 that is not provided with a through-hole 29*a* is attached to the boss portion 27, in a state of being arranged so that the side thereof on which a groove portion 29*b* is formed is the upper face, opposite to the seventh embodiment described above.

Moreover, two fixed contacts 35 and 35 are arranged to protrude upward at positions opposite the drive portion 2 sides of the three movable contacts 31*a*, 31*b*, and 31*c*. Moreover, the contact device 1C of the present embodiment includes two fixed terminals 37 and 37. Each fixed contact 35 is fixed to one of the two fixed terminals 37 and 37. The fixed terminals 37 and 37 are attached respectively to fixed contact holders 41 and 41 made of insulating resin. Note that, the edge portions of the fixed terminals 37 serve as external connection terminals that are extracted from the case 5 and to be connected to an external load or an external power supply.

In the present embodiment, similar to the seventh embodiment, two (a plurality of) fixed contacts 35 and 35 are provided at the fixed terminals 37 and 37. In other words, one (first) fixed contact 35 is provided at one fixed terminal 37, and one (second) fixed contact 35 is provided at the other fixed terminal 37. Then, one fixed contact 35 (left side fixed contact 35 in FIG. 19: first fixed contact 35) is brought into contact with the movable contact 31*a*, and the other fixed contact 35 (right side fixed contact 35 in FIG. 19: second fixed contact 35) is brought into contact with the movable contact 31*b* and the movable contact 31*c*. By the contact, current is allowed to flow between the fixed contacts 35 and the corresponding movable contacts 31*a*, 31*b*, and 31*c*.

Here, due to the pressing spring 33 pressing the movable contact plate 29, the movable contacts 31*a*, 31*b*, and 31*c* are brought into contact with the corresponding fixed contacts 35 with a predetermined pressing force. The spring force of the pressing spring 33 is set to be lower than that of a return spring 23 described above. Thus, in a state in which current is not applied to a coil 13 and the driving force is not provided to a movable core 17, since the elastic force of the return spring 23 overcomes the elastic force of the pressing spring 33, the movable core 17 along with the movable contact plate 29 is moved to the direction away from the stationary core 15 (upward in FIG. 19) and into the state shown in FIG. 19.

Next, an operation of the contact device 1C will be described.

First, in a state in which current is not applied to the coil 13, shown in FIG. 19, the elastic force of the return spring 23 overcomes the elastic force of the pressing spring 33, the movable core 17 is moved in the direction away from the stationary core 15 and into the state shown in FIG. 19 in which the movable contacts 31*a*, 31*b*, and 31*c* have separated from the fixed contacts 35 and 35, and as a result the contact device 1C is turned off.

When current is applied to the coil 13 in the off state, the movable core 17 is attracted to the stationary core 15 by the electromagnetic force against the elastic force of the return spring 23, and approaches the stationary core 15. Thus, each movable contact 31 is brought into contact with corresponding fixed contact 35, and electric conduction between the contacts is realized, and as a result the contact device 1C is turned on.

Thus, in the present embodiment, the vertical direction in FIG. 19 is the moving direction of the movable terminal 28 relative to the fixed terminal 37.

Here, in the present embodiment, the part of the movable terminal 28 pressed by the pressing spring 33 is set such that the spring force center x of the pressing spring 33 (point of application of pressing spring 33) is located inside a triangle T1 formed by connecting the three movable contacts 31*a*, 31*b*, and 31*c*.

Specifically, similar to the seventh embodiment, the movable contact plate 29 of the movable terminal 28 is formed in a substantially trapezoidally-shaped plate, and the three movable contacts 31*a*, 31*b*, and 31*c* are provided on the movable contact plate 29 at positions separated from each other (see FIG. 12).

In the present embodiment, the substantially trapezoidally-shaped movable contact 31*a* is formed by projecting the center portion in the width direction (vertical direction in FIG. 12) at one end side in the longitudinal direction (left side in FIG. 12: short side of movable contact plate 29) of the movable contact plate 29 downward in a substantially trapezoidally shape. Then, the substantially pentagon-shaped movable contacts 31*b* and 31*c* are formed by projecting both end portions in the width direction at the other end side in the longitudinal direction (right side in FIG. 12: long side of movable contact plate 29) of the movable contact plate 29 downward in a substantially pentagon shape.

Moreover, a circular ring-shaped groove portion 29*b* is formed on the upper face of the movable contact plate 29.

Note that, in the present embodiment, different from the seventh embodiment, a through-hole is not provided in the movable contact plate 29.

Also, at both ends of the circular ring shaped groove portion 29*b* in the longitudinal direction of the movable contact plate 29, protrusions (contacting portion) 29*c* and 29*c* are provided protruding upward. Thus, one end of the pressing spring 33 accommodated in the groove portion 29*b* is in contact with only the protrusions (contacting portion) 29*c* and 29*c*. In other words, it is configured such that the pressing spring 33 is not in contact with portions of the inner face of the groove portion 29*b* other than the portions where the protrusions (contacting portion) 29*c* and 29*c* are formed.

Thus, the spring force center x of the pressing spring 33 is located at the intermediate portion between the two protrusions (contacting portion) 29*c* and 29*c*, that is, almost at the center of the groove portion 29*b*.

Moreover, the fixed contact 35 is provided so as to be substantially columnar shape.

Therefore, when viewed from the vertical direction (moving direction of movable terminal 28 relative to fixed terminal 37), three contact regions R1, R2, and R3 between movable contact 31*a*, 31*b*, 31*c* and fixed contact 35, 35 are formed on the movable terminal 28. Then, a triangle T1 is formed by connecting the median points G1, G2, and G3 of the respective contact regions R1, R2, and R3.

In the present embodiment also, similar to the seventh embodiment, the spring force center x of the pressing spring 33 (point of application of pressing spring 33) is set to be located in the triangle T1 formed by connecting the three movable contacts 31*a*, 31*b*, and 31*c* (see FIG. 17).

Specifically, the spring force center x of the pressing spring 33 is located on a line segment L2 connecting a midpoint M1 of a line segment L1 that connects any two of the three contact regions R1, R2, and R3 so that the distance between the contact regions R2 and R3 is the shortest with a point P1 of the remaining contact region R1 at which the distance between the contact region R1 and the midpoint M1 is the shortest.

Also, in the present embodiment, similar to the seventh embodiment, the cross-section of a contacting face 29*d* of the protrusion (contacting portion) 29*c* is formed in an arch shape that is centered on the line segment L2 when viewed from the direction of the line segment L2.

By this embodiment also, functions and effects similar to the seventh embodiment described above can be achieved.

(Ninth Embodiment)

A contact device 1D according to the present embodiment has almost the similar configuration with the eighth embodiment.

Figure 20:
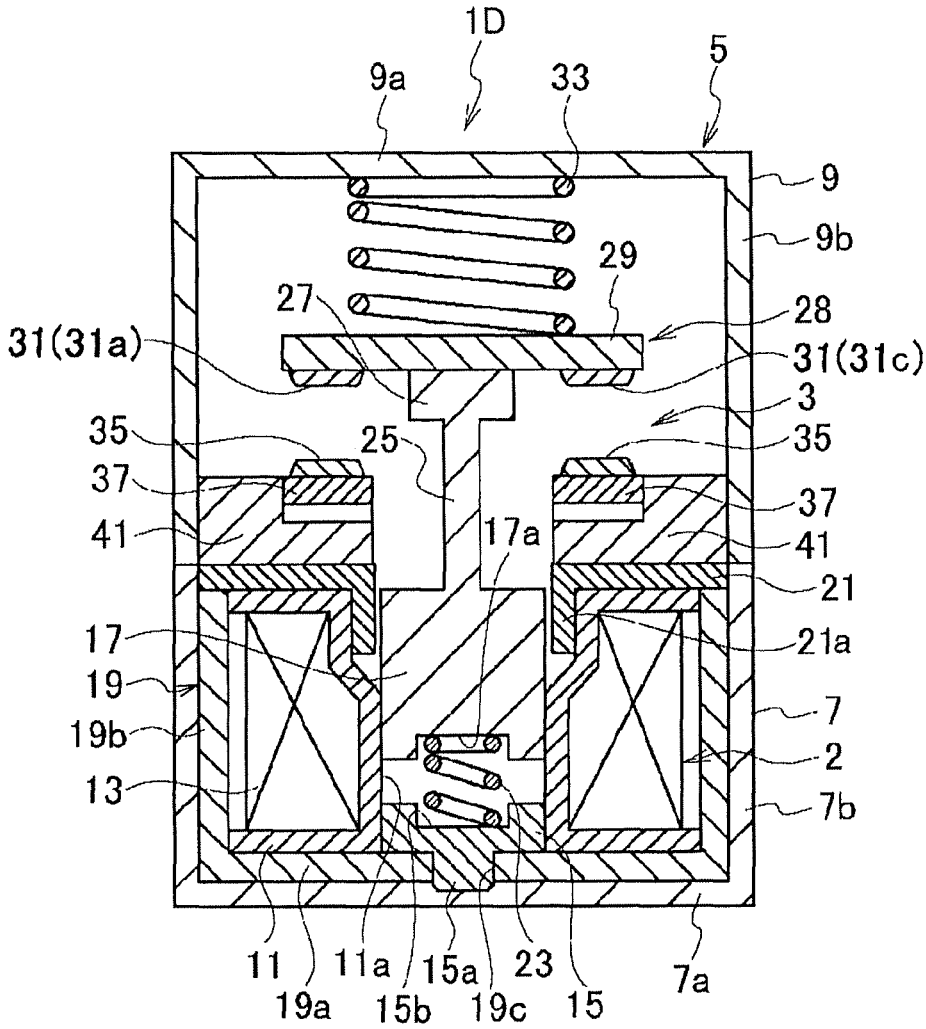
FIG. 20 is a cross-sectional view illustrating a contact device according to a ninth embodiment of the present invention.

That is to say, the contact device 1D of the present embodiment includes a drive portion 2 that is located at a lower portion in FIG. 20, and a contact portion 3 that is located at an upper portion, and these drive portion 2 and contact portion 3 are accommodated in a case 5.

The drive portion 2 includes a coil 13 that is wound around a coil bobbin 11. Inside a through-hole 11*a* formed at the center of the coil bobbin 11, a stationary core 15 as a fixed member is arranged at a lower wall 7*a* side of the drive portion case 7, and a movable core 17 as a movable member is arranged at an opening side which is a side opposite thereof from the lower wall 7*a*.

In the present embodiment also, the vertical direction in FIG. 20 is the moving direction of a movable terminal 28 relative to a fixed terminal 37.

Here, in the contact device 1D according to the invention, three fixed contacts 35, 35, and 35 are formed at positions opposite respective three movable contacts 31*a*, 31*b*, and 31*c* provided on the movable terminal 28.

Then, when viewed from the moving direction of the movable terminal 28 relative to the fixed terminal 37, three contact regions between movable contact 31*a*, 31*b*, 31*c* and fixed contact 35, 35, 35 are formed on the movable terminal 28. In the present embodiment, since the three fixed contacts 35, 35, and 35 are formed at positions opposite the respective movable contacts 31*a*, 31*b*, and 31*c*, the movable contacts 31*a*, 31*b*, and 31*c* are circular contact regions R1, R2, and R3, respectively.

In the present embodiment, the spring force center x of a pressing spring 33 (point of application of pressing spring 33) is located inside an imaginary triangle T2 formed by internal tangents (which are each defined as, among the external common tangents of two contact regions, the tangent formed at the side of the remaining contact region) L3, L4, and L5 of the contact regions R1, R2, and R3. Note that, in the present embodiment, since the movable contacts 31*a*, 31*b*, and 31*c* are each formed in a circular shape, the three internal tangents of the movable contacts 31*a*, 31*b*, and 31*c* coincide with three internal tangents L3, L4, and L5 of the contact regions R1, R2, and R3.

Further in the present embodiment, the spring force center x of the pressing spring 33 is located on a line segment L7 inside the triangle T2.

Specifically, the triangle T2 is defined as a triangle formed by the internal tangents L3, L4, and L5 of the three contact regions R1, R2, and R3. A line segment L6 is defined as a line segment connecting two vertices P2 and P3 (vertices at lower side in FIG. 21) of the triangle T2. The line segment L7 is defined as a line segment connecting the midpoint M2 of the line segment L6 and the remaining vertex P4 of the triangle T2. The spring force center x of the pressing spring 33 (point of application of the pressing spring 33) is located on the line segment L7.

Note that, in the present embodiment also, the contour shape of the movable terminal 28 is similar to the contour shape of the movable terminal 28 of the seventh and eighth embodiments described above, and is formed in line-symmetry with respect to a line including the line segment L7, and as a result the triangle T2 is an isosceles triangle.

As described above, in the present embodiment, the spring force center x of the pressing spring 33 is located on the line segment L7 connecting the midpoint M2 of the line segment L6 that connects two vertices P2 and P3 of the triangle T2 formed by the three internal tangents L3, L4, and L5 of the three contact regions R1, R2, and R3 with the remaining vertex P4.

Thus, by setting the position of the spring force center x of the pressing spring 33 to be on the line segment L7, the spring force center x of the pressing spring 33 is located inside the triangle T1 formed by connecting centers (median point) of the three movable contacts 31*a*, 31*b*, and 31*c*.

Thus, all of the three movable contacts 31*a*, 31*b*, and 31*c* can be pressed toward the fixed contacts 35 by the pressing spring 33, and as a result all of the three movable contacts 31*a*, 31*b*, and 31*c* can be securely brought into contact with corresponding fixed contacts 35. That is to say, the movable contacts 31*a*, 31*b*, and 31*c* can be more securely brought into contact with the fixed contacts 35, 35, and 35 at the three contact regions R1, R2, and R3. Furthermore, since the turning movement of the movable terminal 28 is suppressed, noise of the contact device 1 can be suppressed.

Note that although an example in which a groove portion is not provided in the movable terminal 28 and one end of the pressing spring 33 is in contact with the upper face of the movable terminal 28 is illustrated in the present embodiment, a groove portion may be provided and one end of the pressing spring 33 may be accommodated in the groove portion, similar to the seventh and eighth embodiments described above. At this time, it is preferable that a protrusion (contacting portion) of which the contacting face has an arc-shaped cross-section that is centered on the line segment L7 when viewed from the direction of the line segment L7 is provided in the groove portion.

Note that a spring bearing portion 69 of the second embodiment may be provided on the movable contact plate 29.

Next, a variation of the movable terminal will be described.

Figure 21:
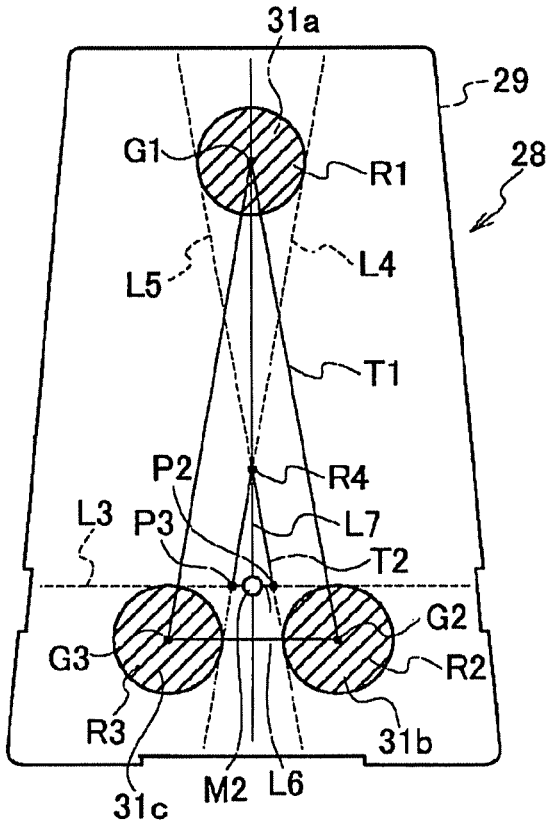
FIG. 21 is a plan view illustrating a movable terminal according to the ninth embodiment of the present invention.
Figure 22:
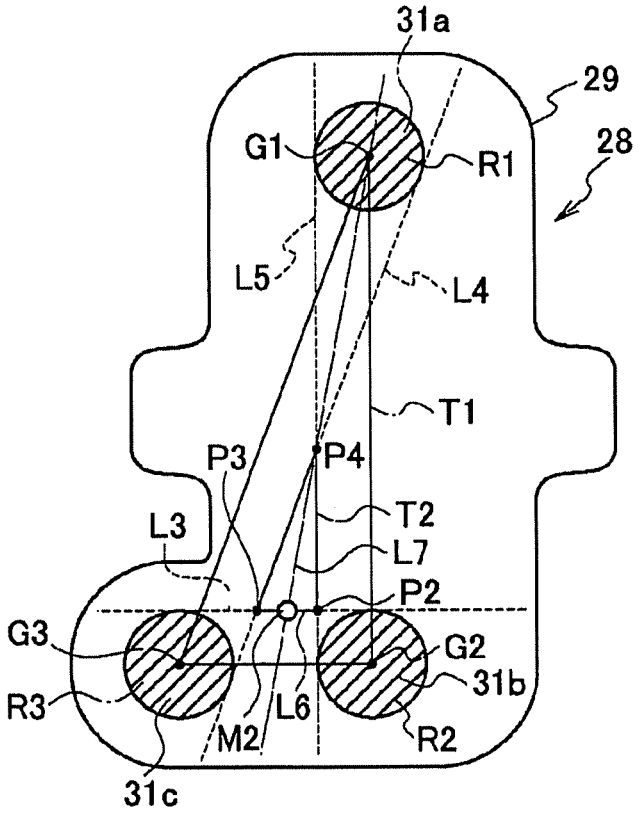
FIG. 22 is a plan view illustrating a variation of the movable terminal according to the ninth embodiment of the present invention.

Although an example in which a triangle T1 formed by connecting the centers of three movable contacts 31*a*, 31*b*, and 31*c* is an isosceles triangle is illustrated in the ninth embodiment, as shown in FIG. 21, three movable contacts 31*a*, 31*b*, and 31*c* may be arranged such that the triangle T1 formed by connecting the centers of the three movable contacts 31*a*, 31*b*, and 31*c* is a right-angled triangle, as shown in FIG. 22.

Even in this case, by setting the location of the spring force center x of the pressing spring 33 to be on the line segment L7 connecting the midpoint M2 of the line segment L6 that connects two vertices P2 and P3 of the triangle T2 formed by the three internal tangents L3, L4, and L5 of the three contact regions R1, R2, and R3 with the remaining vertex P4, the spring force center x of the pressing spring 33 can be arranged inside the triangle T1 formed by connecting the centers of the three movable contacts 31*a*, 31*b*, and 31*c*.

That is to say, even if the three movable contacts 31*a*, 31*b*, and 31*c* are arranged as shown in FIG. 22, functions and effects similar to the ninth embodiment described above can be achieved.

Note that, in the above seventh and eighth embodiments also, the three movable contacts 31*a*, 31*b*, and 31*c* may be arranged such that the triangle T1 is a right-angled triangle.

In a contact device of one modified embodiment, the center of gravity of the movable terminal 28 in the first to the ninth embodiments is located on a line of application of the elastic force of the pressing spring 33 (a line that passes through the point of application 63 of the pressing spring 33 and extends in a direction in which pressing spring 33 extends and contracts).

That is to say, in the first to sixth embodiments, for example, the pressing spring 33 is arranged such that the center of gravity of the movable contact plate 29 is located on the line of application of the pressing spring 33, and three movable contacts 31*a*, 31*b*, and 31*c* are arranged (and fixed contacts 35, 35, and 35 are arranged) such that the center of gravity of the movable terminal 28 is located inside a triangle 67 formed by the three internal tangents 64, 65, and 66. In this case, both of the point of application of the pressing spring 33 and the center of gravity of the movable terminal 28 are located inside the triangle 67 formed by the three internal tangents 64, 65, and 66 of the three movable contacts 31*a*, 31*b*, and 31*c*.

According to this configuration, with the movable terminal 28, both the elastic force of the pressing spring 33 and gravity can be considered to act on the center of gravity of the movable terminal 28. Thus, the turning movement of the movable terminal 28 is further suppressed, and noise of the contact device 1 can be suppressed.

According to the present embodiments described above, in a contact device in which movable contacts 31*a*, 31*b*, and 31*c* are brought into contact with fixed contacts 35 in three regions, the movable contacts 31 can be securely brought into contact with the fixed contacts 35 in all the three regions. Moreover, the turn movement of the movable terminal 28 is suppressed, and noise of the contact device can be suppressed.

Although preferable embodiments of the present invention have been described, the present invention is not limited to the present embodiments described above, and various variations are possible. For example, the configuration of the movable terminal 28 shown in FIGS. 2, 3, and 4, may be used in the contact device 1A shown in FIG. 5, and the configuration of the movable terminal 28 shown in FIGS. 6, 7, 8, 9, and 10 may be used in the contact device 1 shown in FIG. 1.

Moreover, in the seventh and eighth embodiments, although an example in which the shape of the protrusion 29*c* is a part of a column is illustrated, the shape of the protrusion 29*c* may be a part of a sphere.

Moreover, in the seventh to ninth embodiments, the three movable contacts may be arranged to form triangles other than an isosceles triangle and a right-angled triangle.

Moreover, detailed specifications (shape, size, layout, etc.) of the movable terminal, the fixed terminal and other parts may be modified as appropriate.

Although the present invention has been described in a number of preferred embodiments, various modifications and variations are possible by those skilled in the art without departing from the spirit or scope of this invention, that is, without departing from the claims.

The invention claimed is:

1. A contact device comprising:

a plurality of fixed terminals that each include a fixed contact;

a movable terminal that moves toward and away from the fixed terminals and includes three movable contacts to be brought into contact with the fixed contacts;

a pressing spring that presses the movable terminal to bring the movable contacts into contact with the fixed contacts; and a spring receiver which is a separate body from the movable terminal and the pressing spring, is interposed between the movable terminal and the pressing spring, receives one end of the pressing spring and moves together with the movable terminal, wherein:

a point of application of the pressing spring is located in a triangle that is formed by internal tangents of the three movable contacts.

2. The contact device according to claim 1, wherein at least two sides of the triangle that is formed by the internal tangents of the three movable contacts are each tangent to a circle that is centered on the point of application of the pressing spring.

3. The contact device according to claim 1, wherein the point of application of the pressing spring is located on a line segment connecting a midpoint of a line segment that connects two vertices of the triangle that is formed by the internal tangents of the three movable contacts with the remaining vertex of the triangle.

4. The contact device according to claim 3, wherein:

the movable terminal has a groove portion that accommodates one end of the pressing spring, at least a part of the line segment is included in the groove portion, when viewed from the direction in which the movable terminal moves relative to the fixed terminal, a contacting portion that includes a contacting face with which the pressing spring comes into contact is formed in the groove portion, and the contacting face of the contacting portion has an arc-shaped cross-section that is centered on the line segment when viewed from a direction of the line segment.

5. The contact device according to claim 1, wherein the internal tangent is defined as, among external common tangents of two of the three movable contacts, an external common tangent formed closer to a remaining one of the three movable contacts.

* * * * *